US012778303B2

(12) United States Patent
Yang et al.

(10) Patent No.: US 12,778,303 B2
(45) Date of Patent: Nov. 3, 2026

(54) CAMPING CHAIR

(71) Applicant: SHENZHEN THOUSANDSHORES TECHNOLOGY CO., LTD., Shenzhen (CN)

(72) Inventors: Xufeng Yang, Shenzhen (CN); Peiyan Lai, Shenzhen (CN); Junlei He, Shenzhen (CN); Zhengchen Cai, Shenzhen (CN)

(73) Assignee: SHENZHEN THOUSANDSHORES TECHNOLOGY CO., LTD., Shenzhen (CN)

( * ) Notice: Subject to any disclaimer, the term of this patent is extended or adjusted under 35 U.S.C. 154(b) by 127 days.

(21) Appl. No.: 18/939,503

(22) Filed: Nov. 6, 2024

(65) Prior Publication Data

US 2026/0123760 A1 May 7, 2026

Related U.S. Application Data

(60) Provisional application No. 63/634,417, filed on Apr. 15, 2024.

(51) Int. Cl.

| | |
|---|---|
| ***A47C 9/10*** | (2006.01) |
| ***A47C 4/02*** | (2006.01) |
| ***A47C 7/02*** | (2006.01) |

(52) U.S. Cl.

CPC ..... *A47C 9/10* (2013.01); *A47C 4/022* (2013.01); *A47C 7/025* (2013.01)

(58) Field of Classification Search

CPC .. A47C 9/105; A47C 3/02; A47C 4/28; A47C 4/30; A47C 4/34; A47C 4/44

See application file for complete search history.

(56) References Cited

U.S. PATENT DOCUMENTS 335,823 A * 2/1886 Linden ..... A47C 9/105 248/435
361,527 A * 4/1887 Kazanjian ..... A47C 9/105 108/158

(Continued)

FOREIGN PATENT DOCUMENTS

| | | |
|---|---|---|
| CN | 217447144 U | 9/2022 |
| CN | 217488071 U | 9/2022 |
| CN | 220355138 U | 1/2024 |

OTHER PUBLICATIONS

"Camping Chairs, 360° Degree Swivel Folding Chairs for Adults, Lightweight Camping Chair Portable Chairs, Foldable Outdoor Chairs for Travel Camping Hiking Fishing Beach lawns (Green)", Web page <https://www.amazon.com/RODANNY-360%C2%B0Degree-Chair%EF%BC%8CLightweight-Portable-Foldable/dp/B0CCDJ1M7Y/ref=cm_cr_arp_d_product_top?ie=UTF8&th=1>, Jul. 20, 2023.

*Primary Examiner* — Joshua J Michener
*Assistant Examiner* — Nevena Aleksic
(74) *Attorney, Agent, or Firm* — PORUS IP LLC

(57) ABSTRACT

Embodiments of the present disclosure provide a camping chair, comprising a rocking member, an upper support member, a lower support member, and a seat, wherein two ends of the rocking member are connected to the upper support member and the lower support member respectively, and the rocking member includes an elastic device providing rotational resistance and/or restoring force; the upper support member includes several first pipe fittings, one end of each first pipe fitting is connected to the rocking member, and the other end of the each first pipe fitting is connected to the seat; and the lower support member includes several second pipe fittings, one end of each second pipe fitting is connected to the rocking member, and the other end of the each second pipe fitting is in contact with the ground.

15 Claims, 14 Drawing Sheets

(56) References Cited

U.S. PATENT DOCUMENTS

| | | | | |
|---|---|---|---|---|
| 5,028,020 | A * | 7/1991 | Sundholm | F16L 55/035 248/219.4 |
| 10,653,244 | B2 * | 5/2020 | Yang | A47C 3/025 |
| 2010/0314926 | A1 * | 12/2010 | Chesness | A47C 4/286 297/258.1 |
| 2012/0274107 | A1 * | 11/2012 | Chesness | A47C 4/286 297/188.14 |
| 2022/0039556 | A1 * | 2/2022 | Fulbright | A47C 3/18 |
| 2023/0129979 | A1 * | 4/2023 | Djankovich | A47C 7/441 297/32 |
| 2023/0320487 | A1 * | 10/2023 | Jin | A47C 4/286 297/16.2 |
| 2024/0164529 | A1 * | 5/2024 | Guo | A47C 9/10 |
| 2025/0107625 | A1 * | 4/2025 | Zhang | A47C 4/30 |

* cited by examiner

CAMPING CHAIR

CROSS REFERENCE

This application claims the benefit of U.S. Provisional Application No. 63/634,417, filed on Apr. 15, 2024, the entire contents of which are hereby incorporated by reference.

TECHNICAL FIELD

The present disclosure relates to the technical field of seat, and in particular, to a camping chair.

BACKGROUND

With the growing emphasis on user experience, more and more leisure and relaxation devices have been created, such as a camping chair. When a person sits in the camping chair, the camping chair may slightly rock back and forth. The rocking of the camping chair may provide a comfortable user experience for people to help them relax or rest. The camping chair may be used indoors or outdoors. Rocking comfort and storage ease are important aspects that affect the user experience of the camping chair.

Therefore, it is necessary to provide a detachable and rockable camping chair that is easy to store and carry while improving rocking comfort.

SUMMARY

One or more embodiments of the present disclosure provide a camping chair, comprising a rocking member, an upper support member, a lower support member, and a seat. Two ends of the rocking member are connected to the upper support member and the lower support member respectively, and the rocking member includes an elastic device providing rotational resistance and/or restoring force; the upper support member includes several first pipe fittings, one end of each first pipe fitting is connected to the rocking member, and the other end of the each first pipe fitting is connected to the seat; and the lower support member includes several second pipe fittings, one end of each second pipe fitting is connected to the rocking member, and the other end of the each second pipe fitting is in contact with the ground.

In some embodiments, the two ends of the rocking member are detachably connected to the upper support member and the lower support member respectively. The each first pipe fitting of the upper support member includes an upper tube and a first elastic cord, one end of the first elastic cord is connected to the upper tube, and the other end of the first elastic cord is connected to the rocking member; the each second pipe fitting of the lower support member includes a foot tube and a second elastic cord, one end of the second elastic cord is connected to the foot tube, and the other end of the second elastic cord is connected to the rocking member.

In some embodiments, a length of the each first pipe fitting and/or a length of the each second pipe fitting are adjustable. The each first pipe fitting further includes an extension tube and a pipe plug, the extension tube is fixedly connected to the upper tube; one end of the first elastic cord is connected to the pipe plug, and the other end of the first elastic cord is connected to the rocking member; the each second pipe fitting further includes a foot pad, and the foot pad is connected to the foot tube.

In some embodiments, one or more of the upper tube, the foot tube and the extension tube is a plastic pipe fitting with reinforcing ribs or is a plastic inner pipe internally sheathed with reinforcing ribs, the plastic inner pipe with reinforcing ribs is disposed between the upper tube and the first elastic cord, between the foot tube and the second elastic cord, or between the extension tube and the first elastic cord.

In some embodiments, the rocking member includes an upper seat, a lower seat and a torsion spring. Two ends of the torsion spring are fixedly connected to the upper seat and the lower seat respectively; the upper seat includes an upper connector, and the upper connector is connected to the upper support member; the lower seat includes a lower connector, and the lower connector is connected to the lower support member.

In some embodiments, a count of the torsion springs is one or more, each torsion spring has the same or different diameters at both ends, and the each torsion spring is provided with a sound insulating sleeve on an outer side.

In some embodiments, the rocking member further includes a first adjusting member, the first adjusting member adjusts a difficulty degree of rocking of the camping chair by adjusting an elasticity of the torsion spring. The first adjusting member is fixedly connected to the torsion spring and the first adjusting member is in threaded connection with either the upper seat or the lower seat.

In some embodiments, the rocking member further includes a second adjusting member, the second adjusting member adjusts the difficulty degree of rocking of the camping chair by adjusting the elasticity of the torsion spring. The second adjusting member includes a microprocessor, a drive device, an input device, and a communication device. The microprocessor is configured to determine an adjustment instruction; the drive device is configured to adjust the elasticity of the torsion spring based on the adjustment instruction, and the drive device is connected to the first adjusting member or the torsion spring; the input device is configured to input a wobble sensitivity of a current user, the wobble sensitivity is configured to measure the difficulty degree of rocking of the camping chair; the communication device is configured to communicate with the drive device, the input device, and the microprocessor.

In some embodiments, the first adjusting member is provided with a scale line, the scale line is configured to align with a zero position, and the zero position is a position corresponding to the torsion spring in a natural state In some embodiments, the second adjusting member further includes a monitoring recorder and a cloud-based database. The monitoring recorder is configured to monitor and record wobble data of the current user and the wobble sensitivity; the cloud-based database is configured to periodically collect and store the wobble data and the wobble sensitivity obtained by the monitoring recorder; the input device is further configured to input an adaptive mode, and the adaptive mode is configured to periodically determine the wobble sensitivity based on the cloud-based database.

In some embodiments, to periodically determine the wobble sensitivity based on the cloud-based database, the adaptive mode is configured to: periodically obtain the wobble data of the current user and the wobble sensitivity for a previous cycle from the monitoring recorder; obtain a vector database from the cloud-based database; and determine, by the vector database, the wobble sensitivity for a current cycle of the current user based on the wobble data and the wobble sensitivity for the previous cycle.

In some embodiments, the second adjusting member further includes a reminder component, the reminder component is configured to display a reminder message to the current user; the input device is also configured to receive user update feedback and user update request; the monitoring recorder is also configured to record a count of user adjustments; the microprocessor is further configured to: in response to determining that an update triggering condition is satisfied, generate the reminder message and send the reminder message to the reminder component, the update triggering condition includes that the input device receives the user update request, and/or the count of user adjustments in a predetermined time period is greater than a predetermined threshold.

In some embodiments, the rocking member includes an upper seat, a lower seat, a rotation axis, a resilient pad, and a tension spring. The upper seat and the lower seat rotate about the rotation axis, the resilient pad is provided between the upper seat and the lower seat, an upper end of the tension spring is fixedly connected to the upper seat, and a lower end of the tension spring is fixedly connected to the lower seat.

In some embodiments, the rocking member is provided with one or more mounting positions for the tension springs, different mounting positions corresponding to different initial lengths of the tension springs.

In some embodiments, the rocking member includes an upper seat, a lower seat, a rotation axis, a resilient pad, and a compression spring. The upper seat and the lower seat rotate about the rotation axis, the resilient pad is provided between the upper seat and the lower seat, an upper end of the compression spring is fixedly connected to the upper seat, and a lower end of the compression spring is fixedly connected to the lower seat.

In some embodiments, the rocking member includes an upper seat, a lower seat, a rotation axis, a resilient pad, a tension spring, and a compression spring. The upper seat and the lower seat rotate about the rotation axis, the resilient pad is provided between the upper seat and the lower seat, the tension spring is provided on a front side of the camping chair close to the seat, the compression spring is provided on a back side of the camping chair away from the seat, an upper end of the tension spring and an upper end of the compression spring are fixedly connected to the upper seat, and a lower end of the tension spring and a lower end of the compression spring are fixedly connected to the lower seat.

In some embodiments, the camping chair further includes one or more reinforcing members, each reinforcing member is configured to connect adjacent first pipe fittings and/or adjacent second pipe fittings. A reinforcing member of the one or more reinforcing members includes two rods that are hingedly connected and two sleeves, the two sleeves are sleeved on adjacent first pipe fittings and/or the two sleeves are sleeved on adjacent second pipe fittings.

In some embodiments, the camping chair further includes a reinforcement assembly composed of multiple reinforcing members.

In some embodiments, the reinforcing member further includes a hinged limiter, the hinged limiter is configured to determine a maximum extended hinge position.

BRIEF DESCRIPTION OF THE DRAWINGS

The present disclosure will be further illustrated by way of exemplary embodiments, which will be described in detail by means of the accompanying drawings. These embodiments are not limiting, and in these embodiments, the same numbering denotes the same structure.

DETAILED DESCRIPTION

Figure 1A:
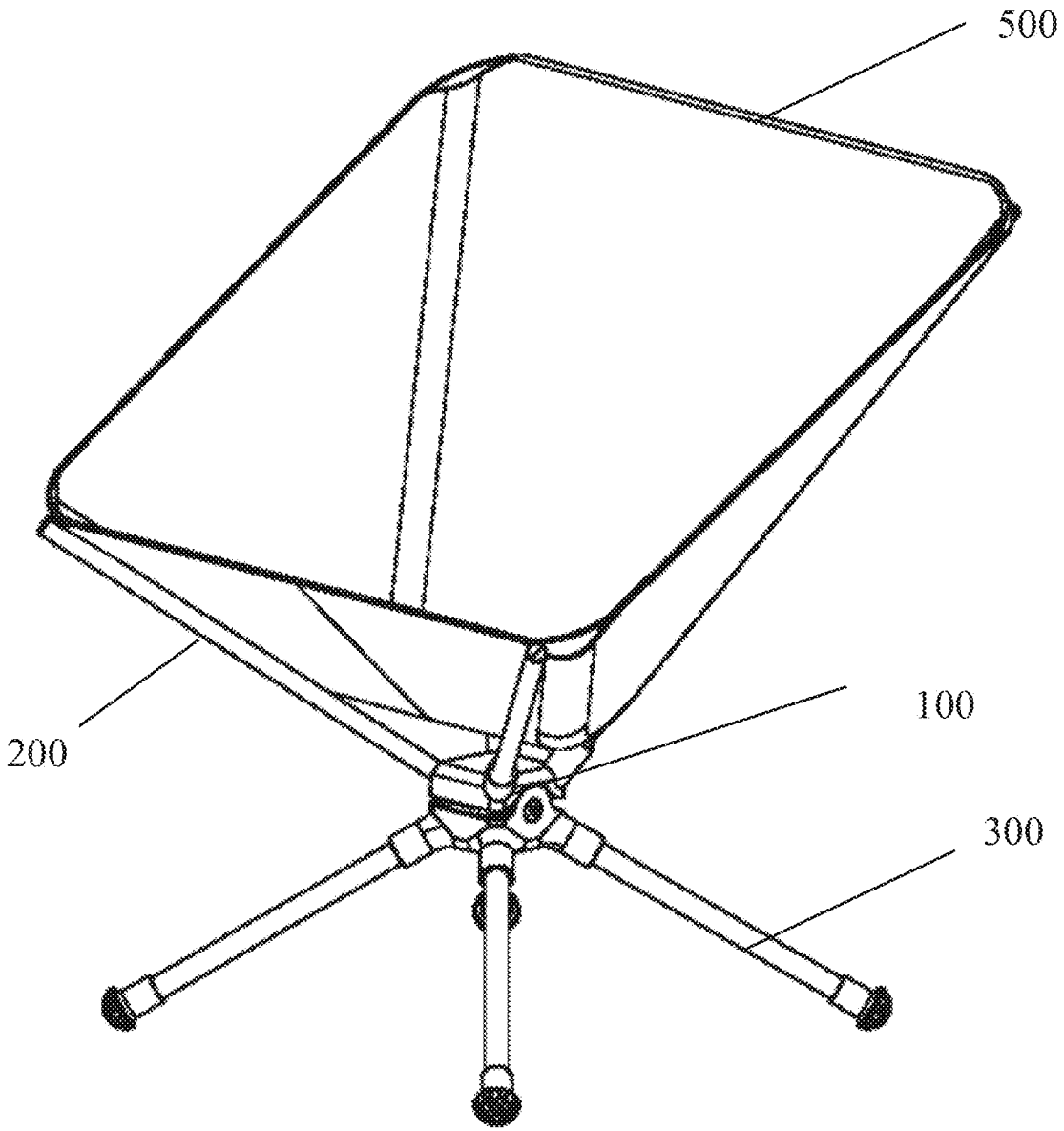
FIG. 1A is a diagram illustrating an exemplary structure of a camping chair according to some embodiments of the present disclosure.

In order to more clearly illustrate the technical solutions of the embodiments of the present disclosure, the accompanying drawings required to be used in the description of the embodiments are briefly described below. Obviously, the accompanying drawings in the following description are only some examples or embodiments of the present disclosure, and it is possible for a person of ordinary skill in the art to apply the present disclosure to other similar scenarios according to these drawings without creative labor. Unless obviously obtained from the context or the context illustrates otherwise, the same numeral in the drawings refers to the same structure or operation.

It should be understood that the terms "system," "device," "unit," and/or "module" as used herein are a way to distinguish between different components, elements, parts, sections or assemblies at different levels. However, the words may be replaced by other expressions if other words accomplish the same purpose.

As shown in the present disclosure and the claims, unless the context clearly suggests an exception, the words "a," "an," "one," and/or "the" do not refer specifically to the singular, but may also include the plural. Generally, the terms "including," and "comprising" only suggest the inclusion of explicitly identified steps and elements that do not constitute an exclusive list, and the method or apparatus may also include other steps or elements.

Flowcharts are used in the present disclosure to illustrate operations performed by a system according to embodiments of the present disclosure. It should be appreciated that the preceding or following operations are not necessarily performed in an exact sequence. Instead, operations may be processed in reverse order or simultaneously. Also, it is possible to add other operations to these processes or remove an operation or operations from these processes.

Figure 1B:
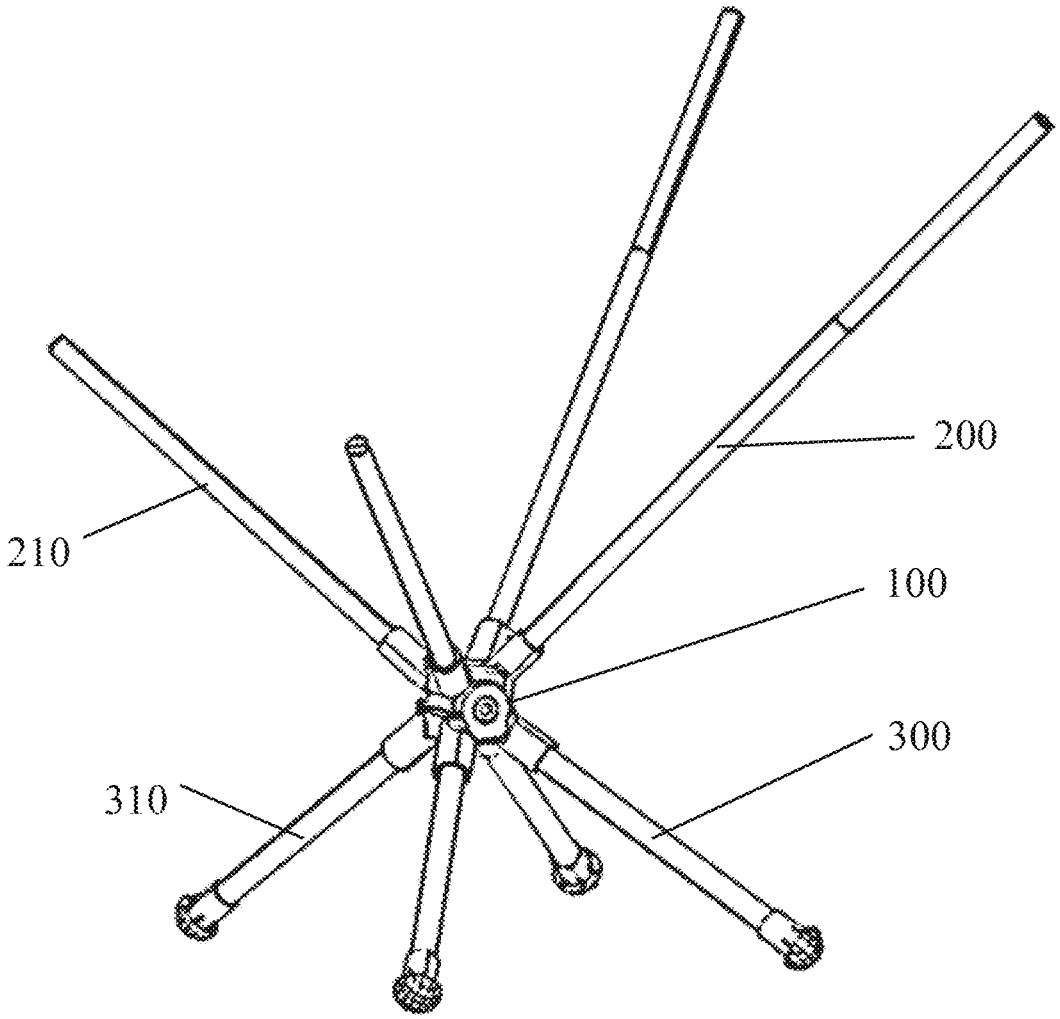
FIG. 1B is a diagram illustrating an exemplary structure of a camping chair without displaying a seat according to some embodiments of the present disclosure.

FIG. 1A is a diagram illustrating an exemplary structure of a camping chair according to some embodiments of the present disclosure. FIG. 1B is a diagram illustrating an exemplary structure of a camping chair without displaying a seat according to some embodiments of the present disclosure.

In some embodiments, as shown in FIG. 1 A and FIG. 1 B, the camping chair may include a rocking member 100, an upper support member 200, a lower support member 300, and a seat 500. Two ends of the rocking member 100 are connected to the upper support member 200 and the lower support member 300, respectively. The rocking member 100 includes an elastic device providing rotational resistance and/or restoring force. The upper support member 200 includes several first pipe fittings, one end of each first pipe fitting 210 is connected to the rocking member 100 and the other end of the each first pipe fitting is connected to the seat 500. The lower support member 300 includes several second pipe fittings, one end of each second pipe fitting 310 is connected to the rocking member 100 and the other end of the each second pipe fitting is in contact with the ground.

In some embodiments, the lower support member 300 is in contact with the ground for supporting the camping chair when the camping chair is placed unfolded. The upper support member 200 is capable of supporting a user when the user is seated on the camping chair. When the camping chair is rocking, a portion of the rocking member 100 that is connected to the upper support member 200 and the upper support member 200 may be rocked at the same time to provide rocking power to the camping chair. The user refers to a person who uses the camping chair.

The seat 500 refers to a portion of the camping chair that is in contact with the body of the user for supporting the user. In some embodiments, the seat 500 may be made from a plurality of materials (e.g., 600D Oxford cloth, 16 amp canvas, or the like). In some embodiments, the seat 500 is connected to the upper support member 200. During the use of the camping chair by the user, the user is seated on the seat 500, and the camping chair is able to rock forward or backward as the user leans forward or backward.

The rocking member 100 refers to a component that connects the upper support member and the lower support member and provides rocking power to the camping chair. In some embodiments, the rocking member 100 may include the elastic device.

The elastic device refers to a device configured to provide at least one of the rotational resistance or the restoring force. In some embodiments, the elastic device may be an elastic material or a structure having elasticity or a combination thereof. For example, the elastic device is a spring, a resilient pad, or the like. When the user uses the camping chair, a rock occurs through human gravity or manual thrust, which causes the elastic material or the structure having elasticity to deform under force and restoring force after deformation. The elastic material may include elastic plastic, elastic rubber, or the like.

In some embodiments, the elastic device may include a torsion spring. The rocking member 100 may include an upper seat, a lower seat, and a torsion spring. Two ends of the torsion spring are fixedly connected to the upper seat and the lower seat, respectively. The upper seat includes an upper connector, and the upper connector 109 is connected to the upper support member. The lower seat includes a lower connector 110, and the lower connector is connected to the lower support member. More details regarding this section may be found in other contents of the present disclosure (e.g., descriptions in connection with FIG. 7 and FIG. 8).

In some embodiments, the elastic device may include the resilient pad and a tension spring. The rocking member 100 may include the upper seat, the lower seat, a rotation axis, the resilient pad, and the tension spring. The upper seat and the lower seat rotate about the rotation axis, the resilient pad is provided between the upper seat and the lower seat, an upper end of the tension spring is fixedly connected to the upper seat, and a lower end of the tension spring is fixedly connected to the lower seat. More details regarding this section may be found in other contents of the present disclosure (e.g., description in connection with FIG. 9).

In some embodiments, the elastic device may include the resilient pad and a compression spring. The rocking member 100 can include the upper seat, the lower seat, the rotation axis, the resilient pad, and the compression spring. The upper seat and the lower seat rotate about the rotation axis, the resilient pad is provided between the upper seat and the lower seat, an upper end of the compression spring is fixedly connected to the upper seat, and a lower end of the compression spring is fixedly connected to the lower seat. More details regarding this section may be found in other contents of the present disclosure (e.g., description in connection with FIG. 10).

In some embodiments, the elastic device may include the resilient pad, the tension spring, and the compression spring. The rocking member 100 may include the upper seat, the lower seat, the rotation axis, the resilient pad, the tension spring, and the compression spring. The upper seat and the lower seat rotate about the rotation axis, the resilient pad is provided between the upper seat and the lower seat, the tension spring is provided on a front side of the camping chair close to the seat 500, the compression spring is provided on a back side of the camping chair away from the seat 500. The upper end of the tension spring and the upper end of the compression spring are fixedly connected to the upper seat, and the lower end of the tension spring and the lower end of the compression spring are fixedly connected to the lower seat. More details regarding this section may be found in other contents of the present disclosure (e.g., description in connection with FIG. 11).

In some embodiments, the rocking member 100 may also be realized by any other feasible means. For example, the rocking member 100 may also be a motorized component eliminating a need for manual adjustment. Exemplarily, the motorized component may include 2 motorized actuators, and the 2 motorized actuators drive the upper support member 200 towards a position near a front side of the seat 500 and away from a rear side of the seat 500, respectively, achieving different heights at the front and back of the upper support member 200, which causes the camping chair to tilt and thus rock.

In some embodiments, the two ends of the rocking member 100 are connected to the upper support member 200 and the lower support member 300.

Connection methods may be any feasible method. For example, the two ends of the rocking member 100 may be fixedly connected to the upper support member 200 and the lower support member 300, respectively. Methods of fixed connection may include, but are not limited to, welding, heat fusion, riveting connection, or the like.

In some embodiments, the two ends of the rocking member 100 may be detachably connected to the upper support member 200 and the lower support member 300, respectively. With a detachable connection, when the user needs to store the camping chair, the upper support member 200 and the lower support member 300 may be separated from the rocking member 100 to reduce the space required for storing the entire camping chair.

Methods of the detachable connection may be any feasible method, including but not limited to a threaded connection, a pin connection, a lock nut connection, a clamp connection, an elastic connection, and a sleeve connection.

As an example only, the detachable connection of the upper support member 200 and the lower support member 300 to the rocking member 100 is the sleeve connection. An inner diameter of a connecting end of one component of two interconnected components (e.g., the upper support member 200 and the rocking member 100, or the lower support member 300 and the rocking member 100) is different from an outer diameter of a connecting end of the other component of the two interconnected components. For example, the upper support member 200 and the rocking member 100 are interconnected, with an outer diameter of a connecting end of the upper support member 200 being slightly smaller than an inner diameter of a connecting end of the rocking member 100, and a fixation is realized by inserting the upper support member 200 into the rocking member 100. As another example, the lower support member 300 and the rocking member 100 are interconnected, with an inner diameter of a connecting end of the lower support member 300 being larger than an outer diameter of a connecting end of the rocking member 100, and a fixation is realized by inserting the rocking member 100 into the lower support member 300.

More details regarding the rocking member may be found in other contents of the present disclosure (e.g., descriptions in connection with FIG. 7 to FIG. 11).

The upper support member 200 refers to a component that is disposed above the camping chair, connected to the seat 500, and configured to support the seat 500. In some embodiments, the upper support member 200 may be detachably connected to the seat 500. Methods of detachable connection include, but are not limited to, the sleeve connection, or the like. For example, the seat 500 is provided with a plurality of cloth cartridges at edges of the seat 500, and the upper support member 200 may be inserted into the cloth cartridges to realize the sleeve connection with the seat 500.

In some embodiments, the upper support member 200 includes several first pipe fittings.

The first pipe fittings refer to components that connect the rocking member to the seat. In some embodiments, one end of each first pipe fitting is connected to the rocking member, and the other end of the each first pipe fitting is connected to the seat.

In some embodiments, a number of the first pipe fittings may be multiple. For example, three, four, or more. Exemplarily, when the number of the first pipe fittings is four, two first pipe fittings closer to the front side of the seat are short, and two first pipe fittings away from the back side of the seat are long, which allows the seat to conform to the hips and lumbar area or the back of the body. The first pipe fittings may be in a plurality of shapes, such as a round tube, a square tube, a triangular tube, or a polygonal tube. Material of the first pipe fittings may be a lightweight but strong material, such as carbon fiber, aluminum alloy, titanium alloy, and magnesium alloy, none of which are limited herein.

Figure 4A:
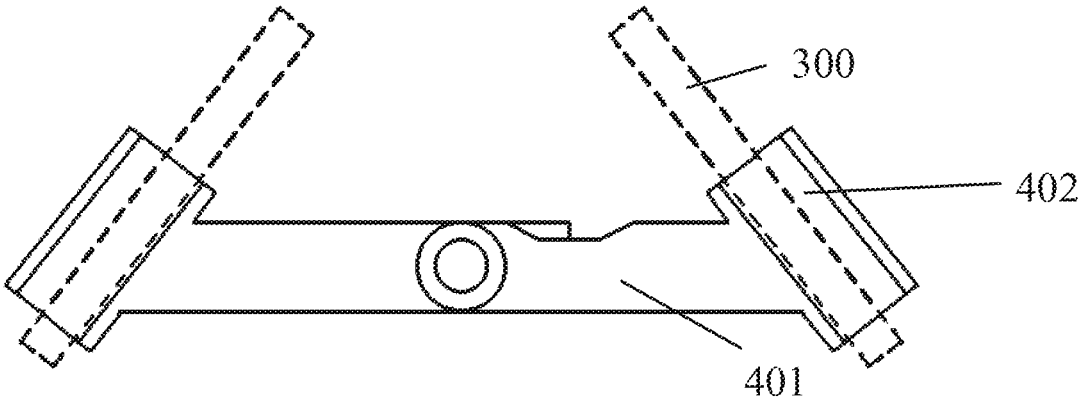
FIG. 4A is a diagram illustrating an exemplary structure of a reinforcing member according to some embodiments of the present disclosure.
Figure 4B:
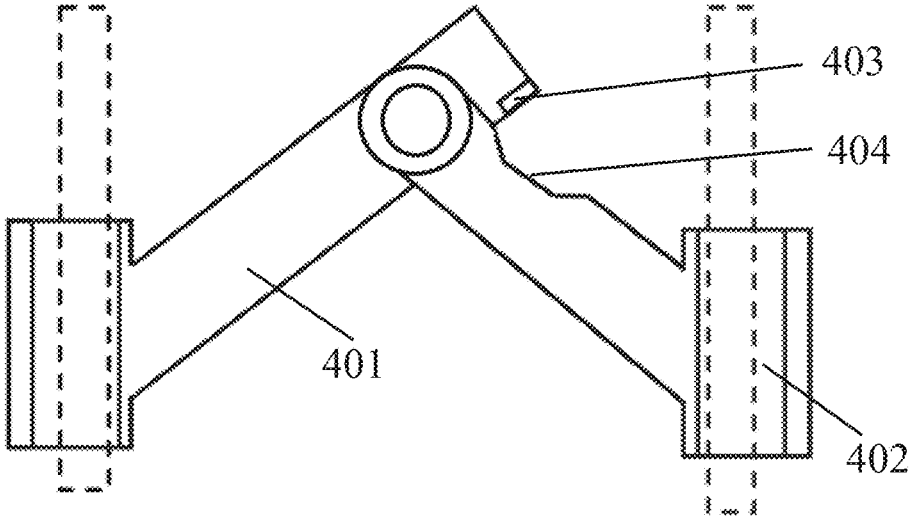
FIG. 4B is a diagram illustrating an exemplary structure of a reinforcing member in a folded state according to some embodiments of the present disclosure.
Figure 4C:
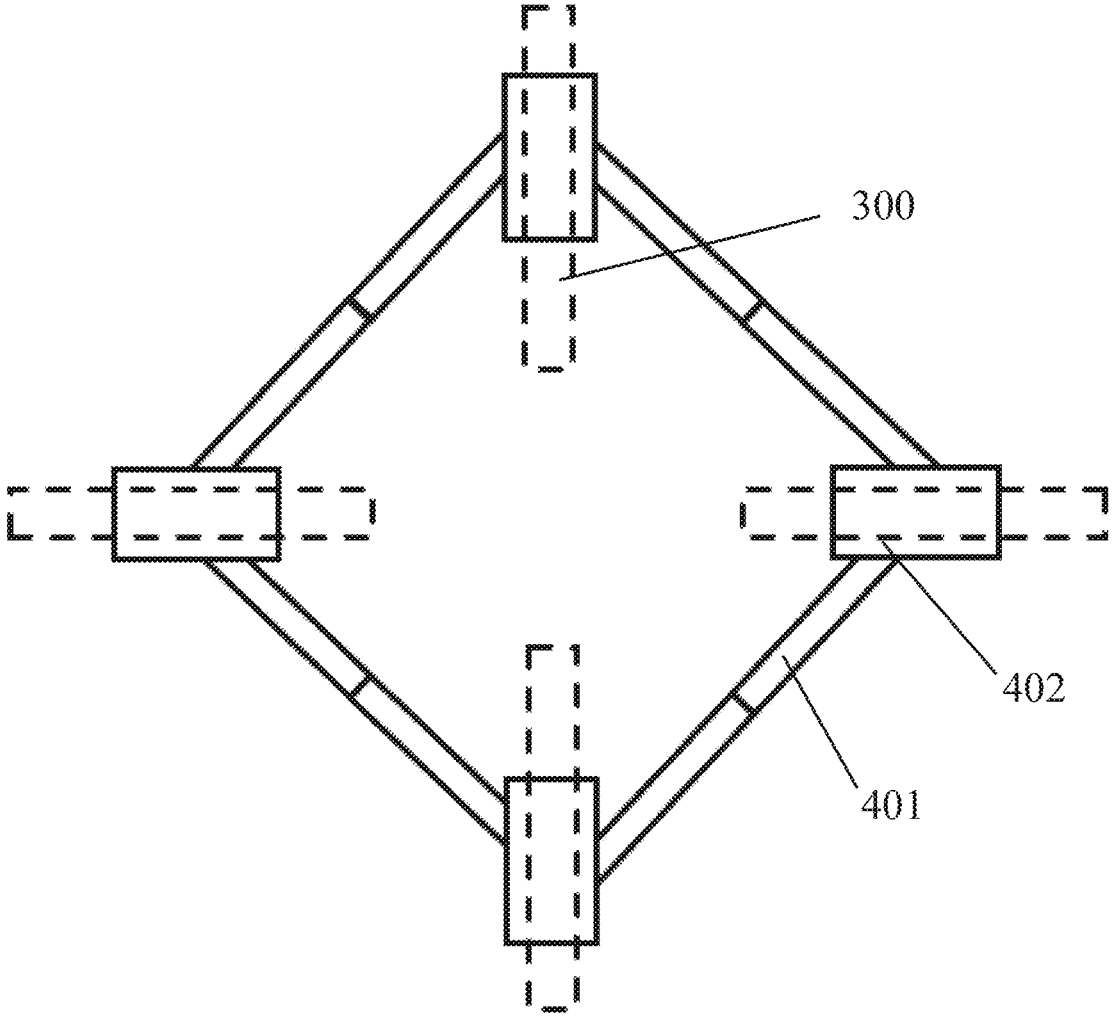
FIG. 4C is a diagram illustrating an exemplary structure of a reinforcement assembly according to some embodiments of the present disclosure.
Figure 5:
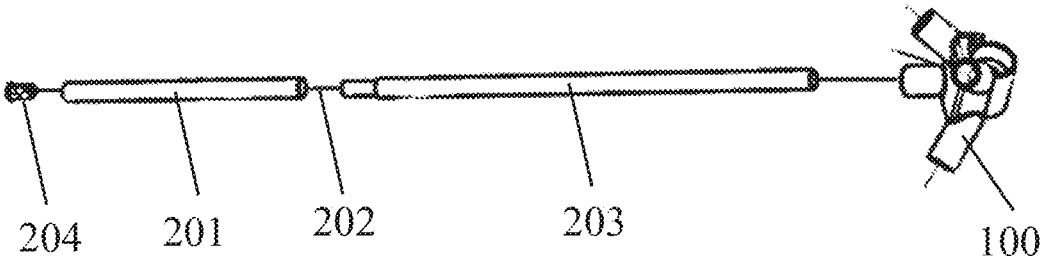
FIG. 5 is a diagram illustrating an exemplary structure of a first pipe fitting according to some embodiments of the present disclosure.

More details regarding the first pipe fittings may be found in other contents of the present disclosure (e.g., descriptions in connection with FIG. 4 and FIG. 5).

The lower support member 300 refers to a component that is located underneath the camping chair, in contact with the ground, and configured to support the seat 500 and the upper support member 200. In some embodiments, the lower support member 300 includes several second pipe fittings.

The second pipe fittings refer to components that connect the rocking member and are in contact with the ground. In some embodiments, one end of each second pipe fitting is connected to the rocking member, and the other end of the each second pipe fitting is in contact with the ground.

In some embodiments, a number of the second pipe fittings may be multiple. For example, three, four, or more. In some embodiments, lengths of the several second pipe fittings meet the same height from the ground when the camping chair is unfolded. The each second pipe fitting may be in a plurality of shapes, such as the round tube, the square tube, the triangular tube, or the polygonal tube. Material of the second pipe fitting may be a lightweight but strong material, such as the carbon fiber, the aluminum alloy, the titanium alloy, and the magnesium alloy, none of which are limited herein.

More details regarding the second pipe fittings may be found in other contents of the present disclosure (e.g., descriptions in connection with FIG. 4 and FIG. 5).

Figure 2:
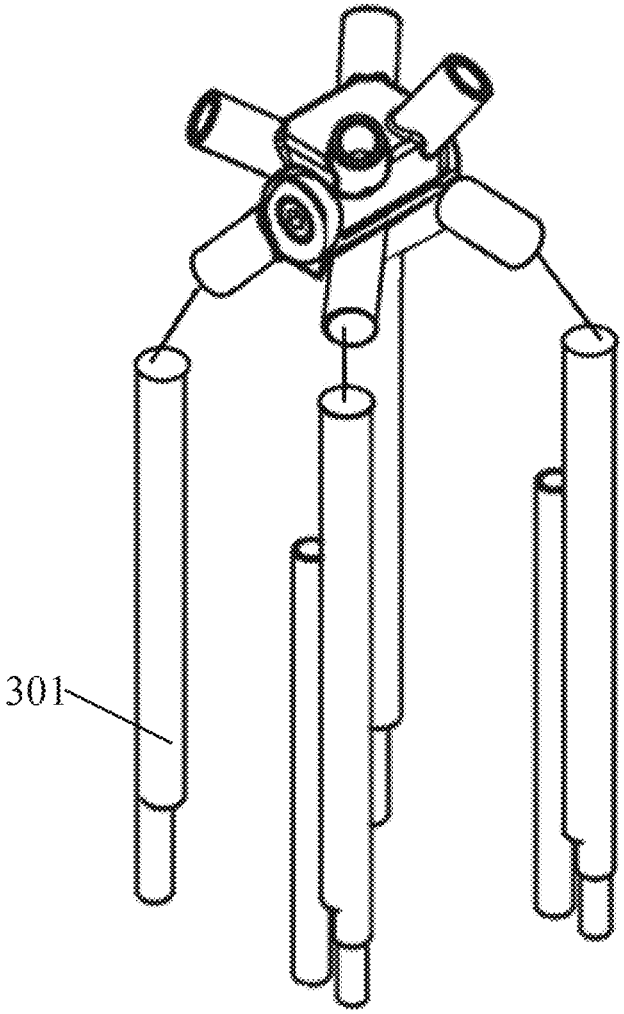
FIG. 2 is an exemplary schematic diagram illustrating a camping chair in a folded state according to some embodiments of the present disclosure.

FIG. 2 is an exemplary schematic diagram illustrating a camping chair in a folded state according to some embodiments of the present disclosure.

In some embodiments, as shown in FIG. 2, the camping chair may be folded for storage when a user is not using the camping chair.

In some embodiments, folding of the camping chair may include separation of the seat 500 from the upper support member 200 or folding of the seat 500, folding of the upper support member 200 and the rocking member 100, and folding of the rocking member 100 and the lower support member 300.

The separation of the seat 500 from the upper support member 200 may be realized based on a detachable connection between the seat 500 and the upper support member 200, and the folding of the seat 500 may be realized based on a material property of the seat. For example, if the seat is made of soft material (e.g., cloth), the seat may be folded freely without separating from the upper support member. If the seat is made of hard material (e.g., alloy), the seat may not be folded freely, and the seat needs to be separated from the upper support member and then stored.

In some embodiments, the folding of the upper support member 200 and the lower support member 300 with the rocking member 100 may be realized by a plurality of ways. For example, elastic cords may also be provided between two ends of the rocking member 100 and the upper support member 200 and the lower support member 300, and the upper support member 200 and the lower support member 300 may be removed by elongation or tension of the elastic cords. Exemplarily, one end of the elastic cord is connected to the upper support member 200, and the other end of the elastic cord is connected to the rocking member 100, and when the camping chair need to be folded, after the upper support member 200 is unfastened, the upper support member 200 is pulled by the elastic cord, and not completely detached from the rocking member 100, which makes the camping chair be folded and stored at will.

As another example, other collapsible connecting components, such as non-elastic cords, may be provided between the two ends of the rocking member 100 and the upper support member 200 and the lower support member 300. Lengths of the non-elastic cords may be adjustable, with different lengths corresponding to an unfolded state or the folded state of the camping chair. Exemplarily, when the camping chair is in the folded state, the lengths of the non-elastic cords are long, at which time the upper support member 200 is not fixed to the rocking member 100, and the camping chair may be folded at will. When the camping chair needs to be unfolded, the lengths of the non-elastic cords are shortened, so that a distance between the upper support member 200 and the rocking member 100 is shortened, and at this time, the upper support member 200 is fixed to the rocking member 100, and the folding is completed. Shortening of the length may be realized by tying a knot at an end of the non-elastic cord, having a spring buckle at the end that may adjust the length, or the like.

In some embodiments, the camping chair may rotate 360 degrees. For example, the upper support member 200 may rotate three hundred and sixty degrees relative to the lower support member 300. Exemplarily, an upper portion and a lower portion of the rocking member 100 are rotationally connected. For example, the upper portion is a swivel shaft and the lower portion is a sleeve, and the swivel shaft and the sleeve are rotatable. As another example, the upper portion and the lower portion are provided with a bearing between thereof, and the upper portion is rotatable relative to the lower portion. Position of rotational connection may also be provided at any other feasible position, such as between the upper support member 200 and the rocking member 100, and between the lower support member 300 and the rocking member 100.

In some embodiments of the present disclosure, by providing the camping chair including the rocking member, the upper support member, the lower support member, and the seat, the interrelationships among the components enable the camping chair to provide the user with a supportive ability and a rocking ability, so that the user can relax and have a good experience when using the camping chair.

Figure 3:
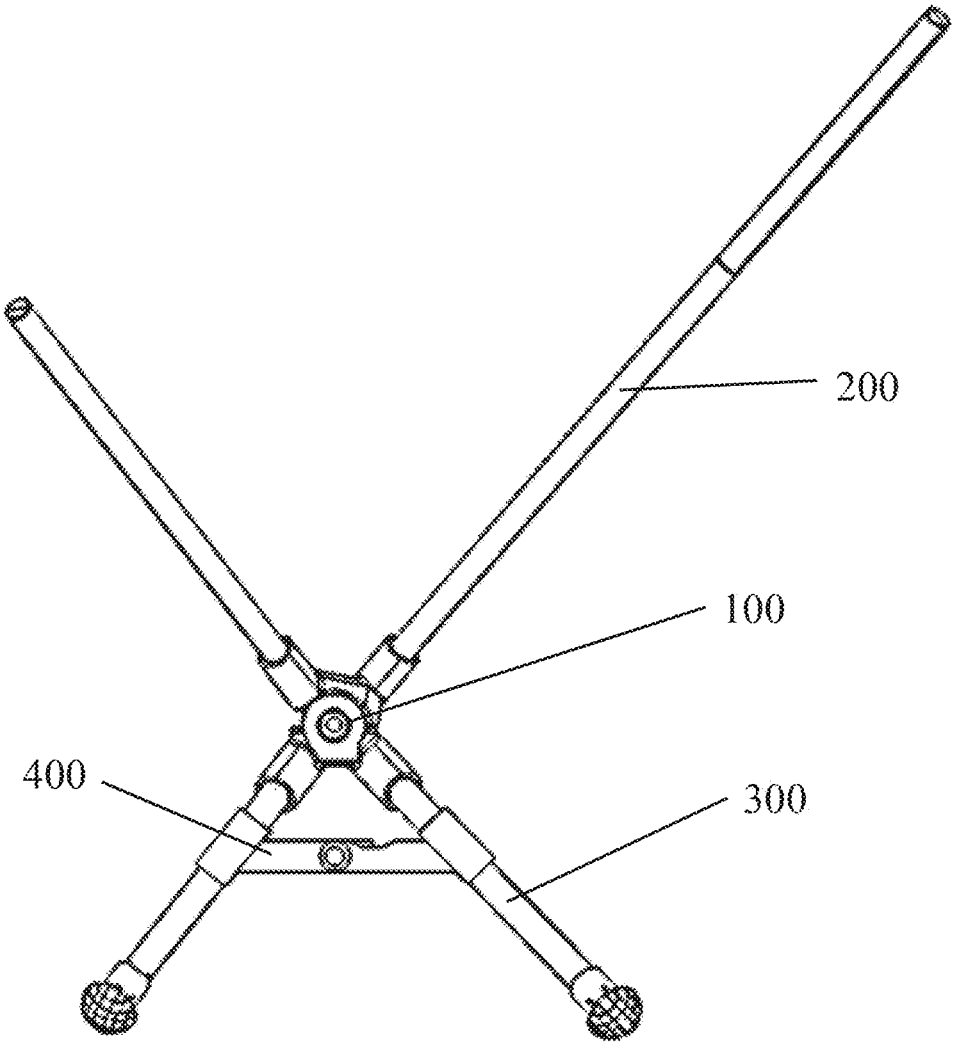
FIG. 3 is a diagram illustrating an exemplary structure of a camping chair including a reinforcing member according to some embodiments of the present disclosure.

FIG. 3 is a diagram illustrating an exemplary structure of a camping chair including a reinforcing member according to some embodiments of the present disclosure; FIG. 4A is a diagram illustrating an exemplary structure of a reinforcing member according to some embodiments of the present disclosure; FIG. 4B is a diagram illustrating an exemplary structure of a reinforcing member in a folded state according to some embodiments of the present disclosure; FIG. 4C is a diagram illustrating an exemplary structure of a reinforcement assembly according to some embodiments of the present disclosure.

In some embodiments, as shown in FIG. 3, the camping chair may further include one or more reinforcing members 400. Each reinforcing member 400 is configured to connect adjacent first pipe fittings and/or adjacent second pipe fittings. For example, the reinforcing member 400 is configured to connect the adjacent second pipe fittings in FIG. 3.

The reinforcing members 400 refer to components for connecting the adjacent first pipe fittings or the adjacent second pipe fittings to add strength and stability to the camping chair. The reinforcing member may be configured to connect two adjacent first pipe fittings, or to connect two adjacent second pipe fittings.

In some embodiments, the material of the reinforcing member 400 may be a lightweight material, such as plastic, aluminum alloy, or the like.

In some embodiments, the reinforcing member 400 may be in a plurality of forms. As shown in FIG. 4A, the reinforcing member 400 may include two rods 401 that are hingedly connected and two sleeves 402. The two sleeves 402 are sleeved on adjacent first pipe fittings and/or the two sleeves 402 are sleeved on adjacent second pipe fittings. For example, the two sleeves 402 are sleeved on the adjacent second pipe fittings, respectively, in FIG. 4A.

The two rods 401 refer to rod-like members connecting two sleeves. The sleeves 402 refer to cartridge-like components sleeved to the first pipe fittings or the second pipe fittings.

In some embodiments, the two rods 401 of the reinforcing member 400 are hinged such that the reinforcing member 400 is collapsible. The two sleeves 402 are sleeved to adjacent fittings.

In some embodiments, any two adjacent first pipe fittings are noted as a first pipe fitting group and any two adjacent second pipe fittings are noted as a second pipe fitting group. The first pipe fitting group may be provided with one reinforcing member, and the second pipe fitting group may be provided with one reinforcing member. One or more of the first pipe fitting groups of the camping chair may be provided with one or more reinforcing members, respectively, while one or more of the second pipe fitting groups of the camping chair may be provided with one or more reinforcing members, respectively.

In some embodiments of the present disclosure, by installing the reinforcing member on the adjacent first pipe fittings and/or the adjacent second pipe fittings, the strength can be increased when the strength of the original pipe fittings is insufficient, which makes the camping chair more stable and improves the use safety of the camping chair. At the same time, the reinforcing member is a lightweight material that can avoid increasing the overall weight of the camping chair and achieve a lightweight effect.

In some embodiments, the reinforcing member 400 may further include a hinged limiter, and the hinged limiter is configured to determine a maximum extended hinge position.

The hinged limiter refers to a component that is configured to limit an unfolding position of the two rods that are hinged. And the hinged limiter may make a maximum extended hinge position to be a horizontally unfolded position (e.g. upper surfaces of the two rods are located in a same horizontal plane).

In some embodiments, the hinged limiter may be in a plurality of forms. As shown in FIG. 4B, the hinged limiter may include a groove 404 on one side of the rod and a protrusion 403 on the other side. By rotating, the protrusion 403 blocks the groove 404, thereby restricting the maximum extended hinge position to the horizontally unfolded position. For example, the hinged limiter may also be two detachable screws, and the two rods 401 are fixed by the two detachable screws for limiting.

In some embodiments of the present disclosure, the hinged limiter allows flexible adjustment of the hinging unfolding degree of the rods and limitation of the maximum extended hinge position, which helps to satisfy different usage requirements of the users.

In some embodiments, the camping chair may also include the reinforcement assembly comprising a plurality of the reinforcing members. As shown in FIG. 4C, the reinforcement assembly may be a monolithic assembly including four sets of rods 401 and four sleeves 402.

In some embodiments of the present disclosure, the strength and stability of the camping chair can be increased through the use of the reinforcing member, and by using the reinforcement assembly, the strength and the stability of the camping chair can be increased even further.

In some embodiments, the reinforcing member 400 may be any other feasible way. For example, two ends of the reinforcing member 400 may be detachably connected (e.g., by a snap connection, by a latch and a bolt) to at least one of the first pipe fittings or the second pipe fittings. For another example, the reinforcing member 400 may be annular, surrounding the first pipe fittings of the upper support member 200 and the second pipe fittings of the lower support member 300, with an elastic catch being provided on at least one of the first pipe fittings or the second pipe fittings, and the reinforcing member is inserted into the elastic catch to connect with at least one of the first pipe fittings or the second pipe fittings.

FIG. 5 is a diagram illustrating an exemplary structure of a first pipe fitting according to some embodiments of the present disclosure.

In some embodiments, two ends of the rocking member are detachably connected to the upper support member and the lower support member, respectively. A first pipe fitting of the upper support member includes an upper tube and a first elastic cord, with one end of the first elastic cord being connected to the upper tube and the other end of the first elastic cord being connected to the rocking member. A second pipe fitting of the lower support member includes a foot tube 301 and a second elastic cord, with one end of the second elastic cord being connected to the foot tube and the other end of the second elastic cord being connected to the rocking member.

The upper tube refers to a tubular body member that forms the first pipe fitting. In some embodiments, the upper tube may be a plurality of shapes, such as a round tube, a square tube, a triangular tube, or a polygonal tube. Material of the upper tube may be a lightweight but strong material, such as carbon fiber, aluminum alloy, titanium alloy, and magnesium alloy, none of which are limited herein.

The first elastic cord refers to a component for defining a position of the upper tube and the rocking member. One end of the first elastic cord is connected to the upper tube and the other end of the first elastic cord is connected to the rocking member. In some embodiments, the first elastic cord may be at least one of an elastic cord or a non-elastic cord described above. More details regarding the elastic cord and the non-elastic cord may be found in other contents of the present disclosure (e.g., description in connection with FIG. 1).

The foot tube refers to a tubular body part that forms the second pipe fitting.

The second elastic cord refers to a component for defining a position of the foot tube and the rocking member. One end of the second elastic cord is connected to the foot tube and the other end of the second elastic cord is connected to the rocking member.

The foot tube is similar to the upper tube, the second elastic cord is similar to the first elastic cord, and the way to realize detachable folding of the camping chair by the first elastic cord and the second elastic cord is similar to that in the FIG. 1.

In some embodiments of the present disclosure, by setting up the detachable connection of the upper support member and the lower support member with the rocking member, and using the first elastic cord and the second elastic cord, the upper support member and the lower support member and the rocking member can be detachable, and then the folding of the camping chair can be realized, which facilitates space saving when storing.

In some embodiments, at least one of a length of each first pipe fitting or a length of each second pipe fitting are adjustable, and the each first pipe fitting further includes an extension tube and a pipe plug, the extension tube being fixedly connected to the upper tube. One end of the first elastic cord is connected to the pipe plug and the other end of the first elastic cord is connected to the rocking member.

That is, as shown in FIG. 5, the each first pipe fitting of the upper support member may include an upper tube 201, a first elastic cord 202, an extension tube 203, and a pipe plug 204. The extension tube 203 is fixedly connected to the upper tube 201, and one end of the first elastic cord 202 is connected to the pipe plug 204 and the other end of the first elastic cord 202 is connected to the rocking member 100. Each second pipe fitting of the lower support member includes the foot tube, the second elastic cord, and a foot pad. The foot pad is connected to the foot tube, and one end of the second elastic cord is connected to the foot tube and the other end of the second elastic cord is connected to the rocking member. With the above construction, two ends of the rocking member may be detachably connected to the upper support member and the lower support member, respectively, and at least one of the length of the first pipe fittings or the length of the second pipe fittings may be adjusted.

The extension tube 203 refers to a component configured to extend the overall length of the first pipe fitting. In some embodiments, the extension tube is fixedly connected to the upper tube. There are various ways to realize a fixed connection, including but not limited to a threaded connection, a sleeve connection, or the like. Exemplarily, when the sleeve connection is used, the extension tube 203 has a small outer diameter at the end near the upper tube 201, which may be inserted into the upper tube 201 and fixedly connected to the upper tube 201.

In some embodiments, a relative position of the upper tube 201 and the extension tube 203 may be adjusted.

In some embodiments, the relative position may be adjusted in a plurality of ways. For example, marbles are provided on the extension tube, and holes corresponding to the marbles are provided on the upper tube. The restriction of the position is realized by the marbles being jammed into the holes, and a plurality of holes corresponds to a plurality of relative positions. The relative positions may be adjusted by the change of the positions of the marbles into the holes. As another example, the extension tube is threadedly connected to the upper tube, and the relative position is adjusted by adjusting the length of a threaded connection portion.

In some embodiments of the present disclosure, by adjusting the relative positions of the upper tube and the extension tube, the seat can be adjusted to obtain different tautness degrees, which conforms to the needs of different people in using the seat. For example, when adjusting the relative positions of the upper tube and the extension tube so that the overall length of the first pipe fittings is short, a cloth seat is looser, and vice versa, the cloth seat is tensed.

The pipe plug 204 refers to a component configured to seal an end of the upper tube, and the use of the pipe plug prevents the entry of foreign matter, or dust, or other things into the upper tube. The connection method of the pipe plug to the upper tube may include a detachable connection, or the like, which will not be discussed herein.

In some embodiments, the second pipe fitting further includes the foot pad, which is connected to the foot tube.

The foot pad refers to a component configured to seal one end of the foot tube, and the use of the foot pad avoids the entry of foreign matter or dust or other things into the foot tube, fine-tunes a height of the camping chair, and realizes shock absorption and noise reduction. In some embodiments, there are various ways to realize the foregoing effect. For example, the foot pad is threaded to the foot tube, and the height of the camping chair is adjusted by adjusting a position of the thread. As another example, the foot pad is an elastic snap that snaps into the foot tube, and a plurality of positions of the snaps correspond to a plurality of fine-tuned heights of the camping chair. As another example, a material of the foot pad may be an elastic material, such as rubber, which enables shock absorption and noise reduction when the camping chair rocks back and forth.

In some embodiments, the length of the first pipe fittings and the length of the second pipe fittings are adjustable. The first pipe fitting of the upper support member may also include the upper tube and the extension tube, with one end of the extension tube being connected to the upper tube and the other end of the extension tube being connected to the rocking member. The second pipe fitting of the lower support member may further include the foot tube and the extension tube, with one end of the extension tube being connected to the foot tube and the other end of the extension tube being connected to the rocking member.

In some embodiments, at least one of the length or a number (or count) of the first pipe fittings and a number (or count) of the second pipe fittings may be flexibly adjusted based on actual needs of the users.

A length adjustment of pipe fittings may be realized in a plurality of ways. Taking the first pipe fitting as an example, the length of the first pipe fitting may be adjusted in a plurality of ways, such as by changing the relative position of the upper tube and the extension tube, by increasing or decreasing a number (or count) of the extension tubes to be used, by changing the length of the upper tube, or the like. Changing the length of the upper tube may be realized by replacing the upper tube with a different length or using a deformable bend as the upper tube, or the like. The adjustment of the number of pipe fittings may be realized in a plurality of ways. For example, increasing or decreasing the number of the extension tubes to be used, or the like.

The actual needs of the users may include a need for the height of the camping chair of the users. The existence of the user need to adjust a great height of the camping chair may be realized by increasing at least one of the length or the number of the first pipe fittings and the number of the second pipe fittings. The existence of the user need to adjust a low height of the camping chair may be realized by decreasing at least one of the length or the number of the first pipe fittings or the number of the second pipe fittings.

In some embodiments of the present disclosure, flexibly adjusting at least one of the length or the number of the first pipe fittings and the number of the second pipe fittings, bases on the actual needs of the users, can make the height of the camping chair more in line with the actual needs of the users.

In some embodiments of the present disclosure, the upper tube of the upper support member is detachably connected to an upper portion of the rocking member, and the foot tube of the lower support member is detachably connected to a lower portion of the rocking member, which is convenient for storage. The upper tube and the foot tube can also be connected to the rocking member by the elastic cord, which is convenient for storage and installation; and the upper support member can be provided with the extension tube, which reduces a volume after storing and makes it convenient to carry. At least one of the length or the number of pipe fittings can be adjusted, which can flexibly adjust the height of the camping chair for users with different heights or different needs to improve the scope of application of the camping chair.

In some embodiments, one or more of the upper tube, the foot tube, and the extension tube may be a plastic pipe fitting with reinforcing ribs or a plastic inner pipe internally sheathed with reinforcing ribs. The plastic inner pipe with reinforcing ribs is disposed between the upper tube and the first elastic cord, between the foot tube and the second elastic cord, or between the extension tube and the first elastic cord.

Figure 6:
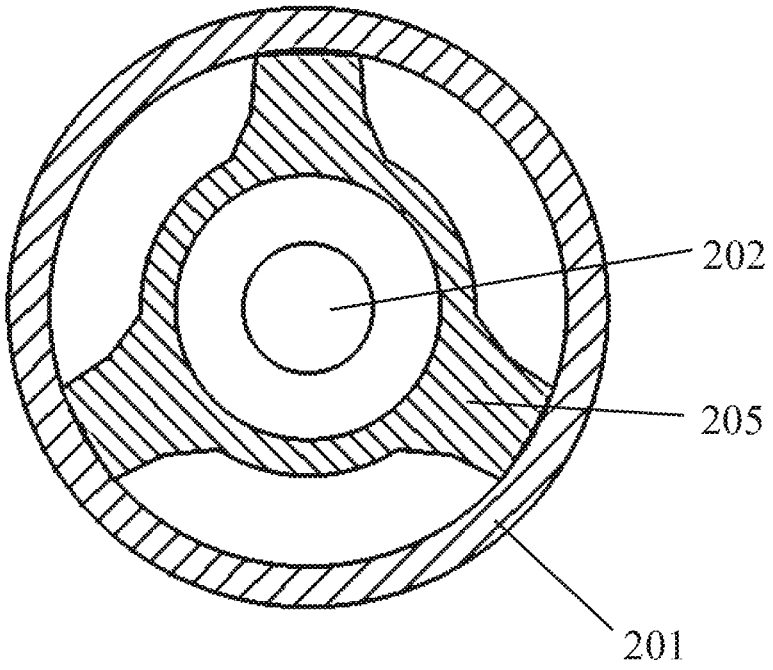
FIG. 6 is a diagram illustrating an exemplary structure of a reinforcing rib according to some embodiments of the present disclosure.

In some embodiments, taking the upper tube as an example, the first pipe fitting further includes the reinforcing rib 205, the reinforcing rib 205 being disposed between the upper tube 201 and the first elastic cord 202, as shown in FIG. 6.

The reinforcing rib 205 refers to a component that adds strength and rigidity to the tubing. For example, the upper tube 201 is a thin aluminum alloy tube or a thin plastic tube, and the strength of the upper tube may be increased by providing the reinforcing rib 205 without additional weight.

In some embodiments, the reinforcing rib 205 may include a plurality of shapes. For example, mesh (e.g., axial, circumferential staggering), or the like, to achieve increased strength while reducing material.

In some embodiments of the present disclosure, by setting the pipe fittings to be the plastic pipe fittings with reinforcing ribs or the plastic inner pipes sheathed with reinforcing ribs, the pipe fittings can be made lighter. An outer side being a smooth pipe fitting is convenient to clean the pipe fitting. At the same time, the inner side with the reinforcing ribs can increase the strength of the pipe fittings, so that the pipe fittings can have a great resistance to pressure, thus making the camping chair widely applicable.

Figure 7:
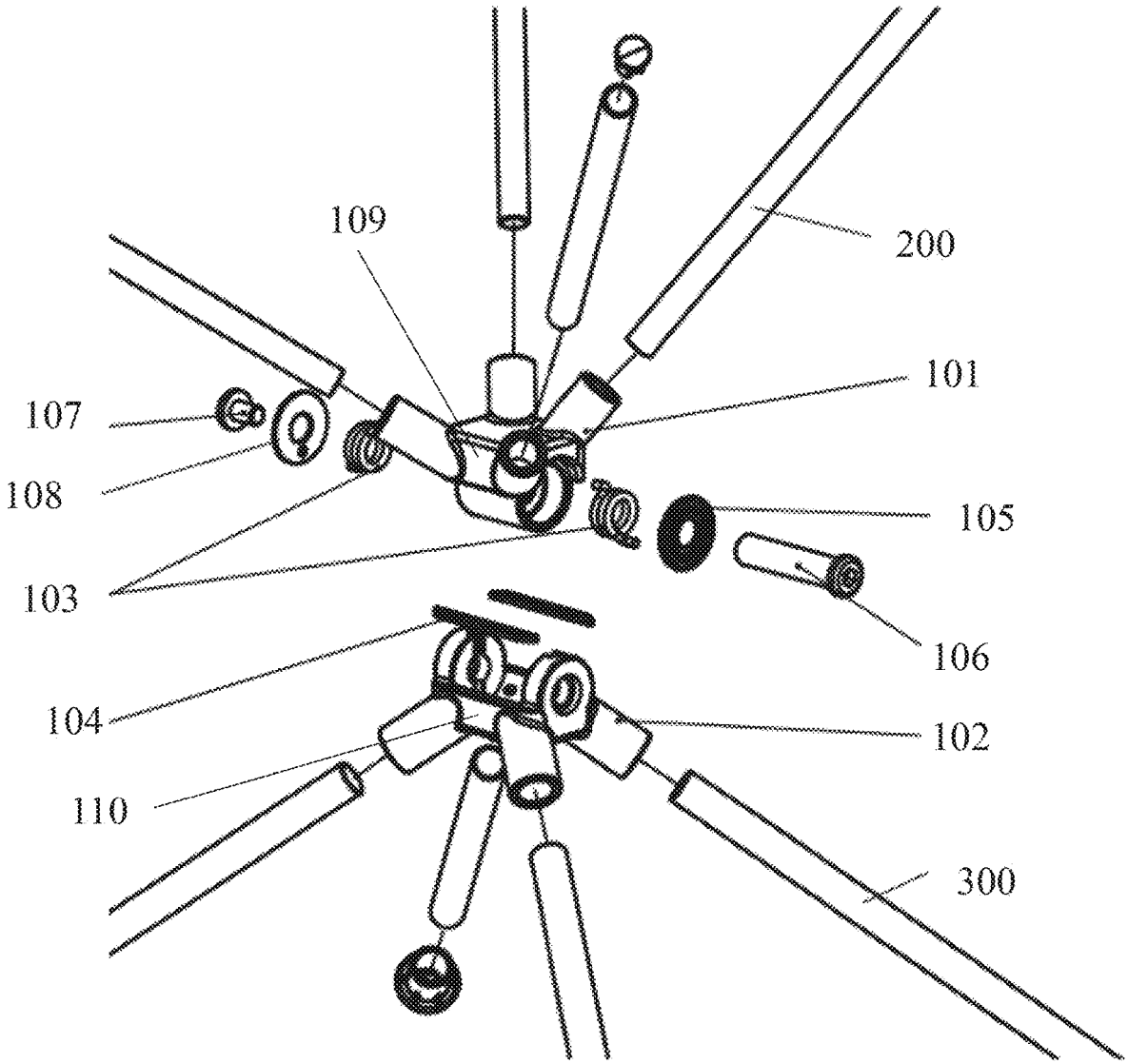
FIG. 7 is a diagram illustrating an exemplary exploded structure of a rocking member including a torsion spring according to some embodiments of the present disclosure.
Figure 8:
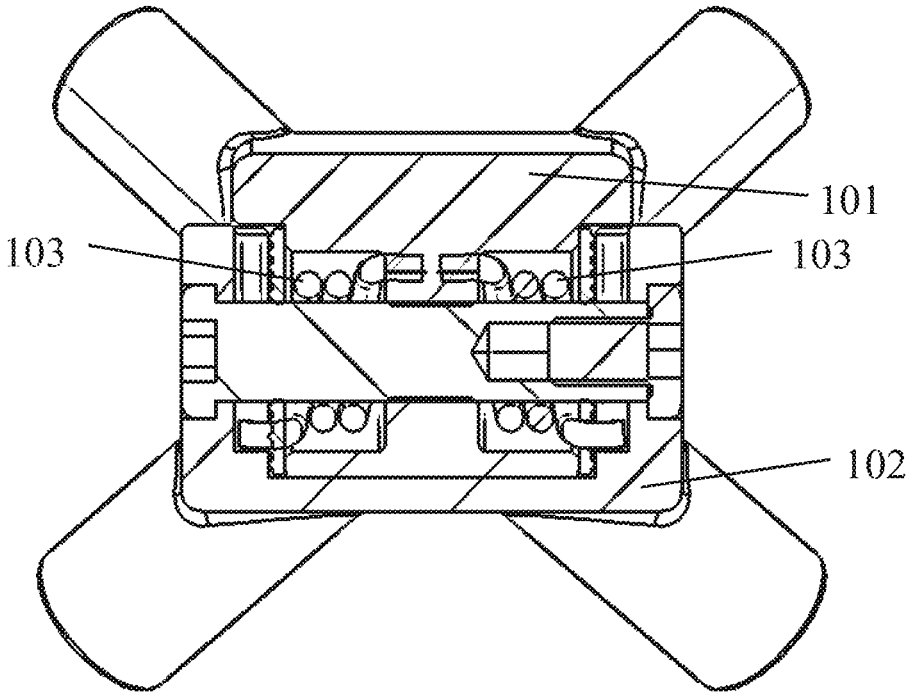
FIG. 8 is an exemplary cross-sectional view illustrating a rocking member including a torsion spring according to some embodiments of the present disclosure.

FIG. 7 is a diagram illustrating an exemplary exploded structure of a rocking member including a torsion spring according to some embodiments of the present disclosure. FIG. 8 is an exemplary cross-sectional view illustrating a rocking member including a torsion spring according to some embodiments of the present disclosure.

In some embodiments, as shown in FIG. 7 and FIG. 8, the rocking member 100 includes an upper seat 101, a lower seat 102, and a torsion spring 103. Two ends of the torsion spring 103 are fixedly connected to the upper seat 101 and the lower seat 102, respectively. The upper seat 101 includes an upper connector, and the upper connector is connected to the upper support member 200. The lower seat 102 includes a lower connector, and the lower connector is connected to the lower support member 300.

The upper seat 101 refers to an upper half of the rocking member. The lower seat 102 refers to a lower half of the rocking member.

In some embodiments, the upper seat 101 and the lower seat 102 have corresponding shapes, and the two may be adapted to be connected.

In some embodiments, the upper seat 101 includes the upper connector, and the upper connector is connected to the upper support member 200. The lower seat 102 is similar to the upper seat 101, and is provided with the lower connector, and the lower connector is connected to the lower support member 300. The upper connector and the upper seat 101, and the lower connector and the lower seat 102 may be monolithic. For example, different features of a same component may be made of different components that are fixedly connected. In some embodiments, the upper connector and the lower connector may also be apertures adapted to fit into pipe fittings, into which the pipe fittings may be inserted to achieve the fixation.

The torsion spring 103 refers to a mechanical part that works by using elasticity. The operation principle of the torsion spring is to utilize elastic deformation properties of materials, torsion deformation of the torsion spring occurs under an action of an external force, and the torsion spring may be restored to its original state when the external force is removed.

In some embodiments, the two ends of the torsion spring are fixedly connected to the upper seat and the lower seat, respectively. And under the action of the torsion spring 103, the upper seat 101 may rock relative to the lower seat 102 when the camping chair is pushed or leaned on, thereby causing the camping chair to rock.

In some embodiments, there may be a plurality of ways to realize the fixed connection of the torsion spring to the upper seat and the lower seat. For example, the upper seat 101 and the lower seat 102 may be provided with mounting holes or mounting grooves, and the two ends of the torsion spring 103 are respectively snapped into the mounting holes or the mounting grooves, thereby realizing the fixation. As another example, the upper seat 101 and the lower seat 102 may be provided with lugs, and the two ends of the torsion springs 103 are inserted into the lugs to achieve the fixation.

In some embodiments, the rocking member 100 further includes a cushion 104, a spacer 105, a screw 106, a bolt 107, and a torsion spring retainer 108, as shown in FIG. 7. The cushion 104 may be an elastic rubber or an elastoplastic to dampen the rock of the rocking member 100, thereby improving the comfort of the rock. The cushion 104 may also be configured to define a limit position of the rock of the camping chair. The spacer 105 and the torsion spring retainer 108 may be configured to limit an axial position of the torsion spring 103, so that the torsion spring 103 does not run during torsional deformation. The spacer 105 may be provided between the upper seat 101 and the lower seat 102. Material of the spacer 105 may be a material, and the spacer 105 may avoid rattling from a contact between the upper seat 101 and the lower seat 102 when the camping chair rocks, thus reducing noise. The screw 106 and the bolt 107 may be configured for mounting and securing the torsion spring 103. The screw 106 may also act as a rotation axis, with the upper seat 101 and the lower seat 102 rotating around the screw 106.

In some embodiments, a count of the torsion spring 103 is one or more, each torsion spring 103 have the same or different diameters at both ends, and the each torsion spring 103 is provided with a sound insulating sleeve on an outer side.

It is to be understood that if only for realizing a rocking function of the camping chair, the count of the torsion spring 103 may be set to one, and the two ends are fixed with the upper seat 101 and the lower seat 102 respectively. If a balanced degree of rocking of the camping chair is also considered, the torsion springs 103 may be set to two or more.

In some embodiments, the diameters of the two ends of the torsion spring 103 may be the same or different. In this regard, when the torsion spring 103 is squeezed by the external force, the different diameters of the two ends of the torsion spring 103 may provide space for a contraction of the torsion spring, which facilitates the contraction deformation of the torsion spring. The diameters of the torsion spring refer to a sum of diameters of coils that make up the torsion spring. The diameters of the two ends of the torsion spring are diameters of the coils that make up the two ends of the torsion spring.

In some embodiments, the outer side of the torsion spring 103 may also be provided with the sound insulating sleeve. For example, the sound insulating sleeve is disposed between the torsion spring 103 and the upper seat, with the sound insulating sleeve covering the torsion spring 103.

The sound insulating sleeve refers to a component that insulates the sound emitted when the torsion spring deforms. In some embodiments, material of the sound insulating sleeve may be a sound-insulating material, for example, acoustic foam cotton, or the like.

In some embodiments of the present disclosure, by setting different counts of the torsion springs, different needs for designing the camping chair can be met; by setting different diameters of the torsion springs, it is conducive to deformation contraction of the torsion springs; and by setting the sound insulating sleeve on the outer side of the torsion spring, the noise emitted during deformation of the torsion springs can be reduced, providing a good user experience.

Figure 12:
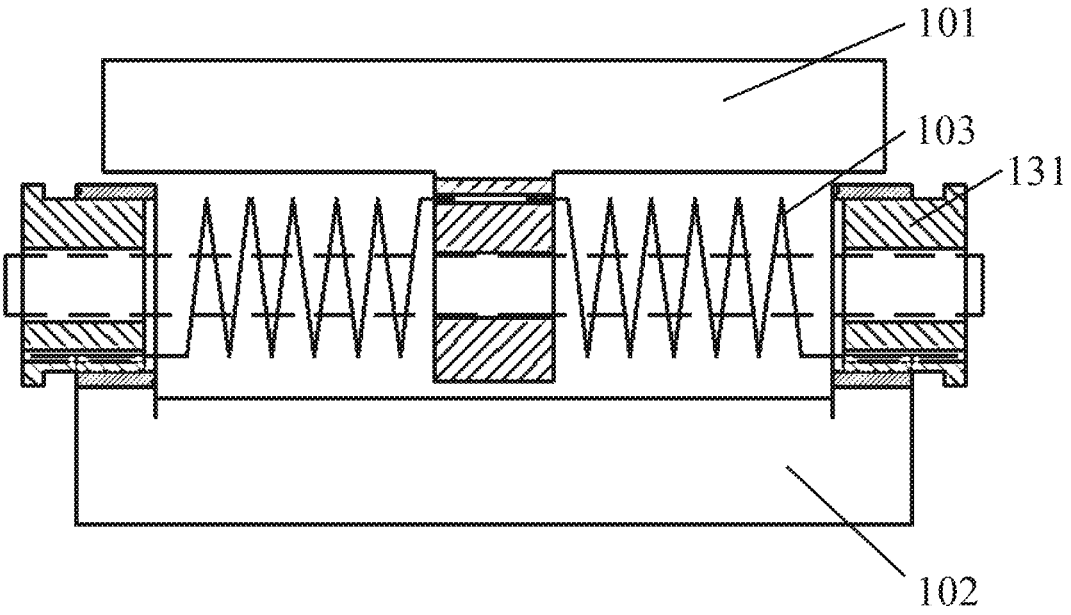
FIG. 12 is a diagram illustrating an exemplary structure of an adjusting member according to some embodiments of the present disclosure.

In some embodiments, the rocking member further includes a first adjusting member and a second adjusting member, and more details regarding this section may be found in other contents of the present disclosure (e.g., description in connection with FIG. 12).

In some embodiments of the present disclosure, by setting the rocking member to include the torsion spring, resistance provided by the torsion spring as it deforms can be fully utilized to achieve the rocking of the camping chair.

Figure 9:
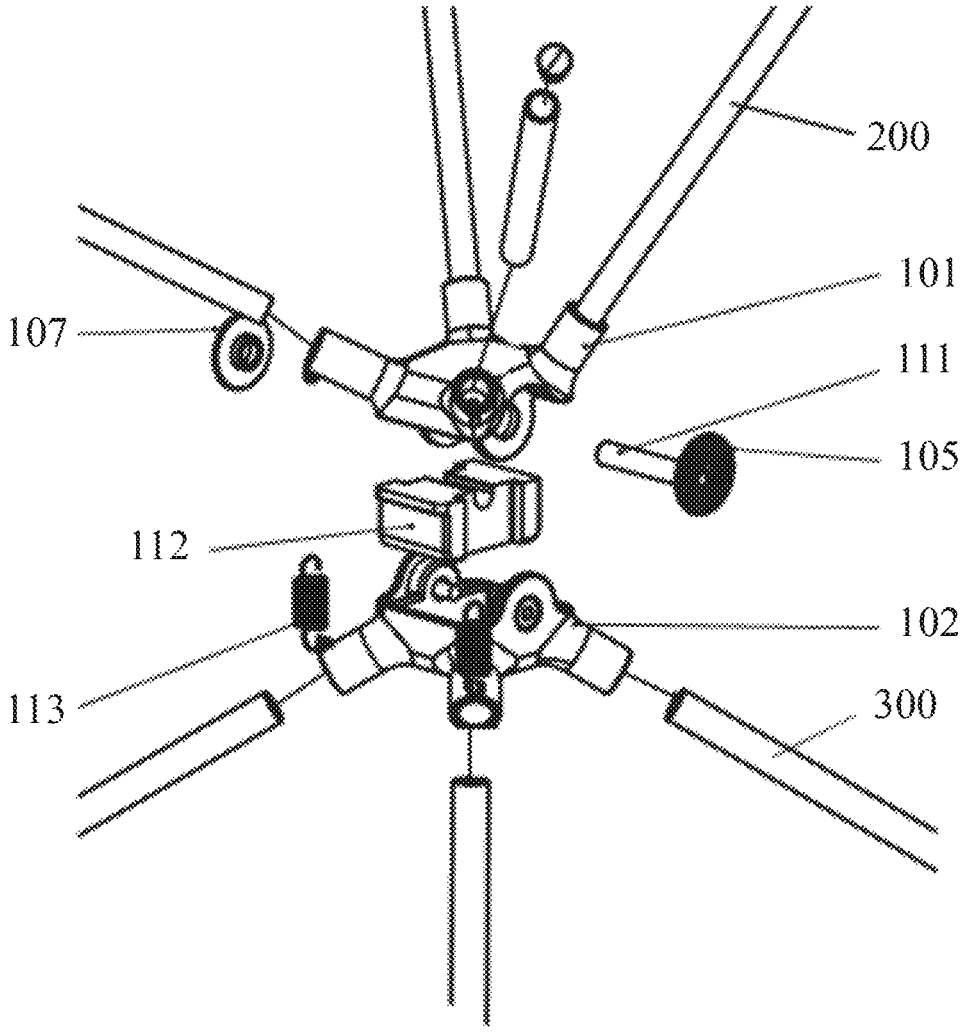
FIG. 9 is a diagram illustrating an exemplary exploded structure of a rocking member including a tension spring according to some embodiments of the present disclosure.

FIG. 9 is a diagram illustrating an exemplary exploded structure of a rocking member including a tension spring according to some embodiments of the present disclosure.

In some embodiments, as shown in FIG. 9, the rocking member includes the upper seat 101, the lower seat 102, a rotation axis 111, a resilient pad 112, and the tension spring 113. The upper seat 101 and the lower seat 102 rotate about the rotation axis 111, the resilient pad 112 is provided between the upper seat 101 and the lower seat 102, an upper end of the tension spring 113 is fixedly connected to the upper seat 101, and a lower end of the tension spring 113 is fixedly connected to the lower seat 102.

More details regarding the upper seat 101 and the lower seat 102 may be found in other contents of the present disclosure (e.g., descriptions in connection with FIG. 7 and FIG. 8).

The rotation axis 111 refers to a shaft component about which the upper seat and the lower seat rotate when the rocking member rocks. In some embodiments, the upper seat 101 and the lower seat 102 rotate about the rotation axis 111.

The resilient pad 112 refers to a component that provides restoring force and cushioning. The resilient pad 112 may be made of resilient materials, such as resilient rubber, resilient plastics, resilient metals (e.g., a copper alloy), and composite materials (e.g., a fiber-reinforced composite).

In some embodiments, the resilient pad 112 is provided between the upper seat 101 and the lower seat 102. The middle of the resilient pad 112 may be provided with a curved groove that fits with the rotation axis, avoiding relative scampering of the resilient pad 112 with the upper seat 101 or the lower seat 102 during the rocking of the camping chair.

The tension spring 113 refers to a helical spring that is subjected to axial tension and is also called an extension spring. When not subjected to loads, coils of the tension spring are tightened without clearance between the coils. The operation principle of the tension spring is to produce a reverse action when the tension spring is stretched or pulled apart. For example, when the tension spring is stretched or pulled apart, it tries to return to its original state, providing a reverse tension. In some embodiments, the upper end of the tension spring 113 is fixedly connected to the upper seat 101, and the lower end of the tension spring 113 is fixedly connected to the lower seat 102 for providing the restoring force to the upper seat and the lower seat.

In some embodiments, the tension spring 113 is provided on one side of the resilient pad 112, such as a front side, as shown in FIG. 9. The tension spring 113 is stretched during installation, causing the upper support member 200 to tilt slightly toward the front side. When a user leans backward on the camping chair, the upper support member 200 rocks backward, at which time the tension spring 113 is in a state where it is further stretched, and a tension of the tension spring 113 (i.e., the tension spring is stretched with a contraction tendency to return to its original length) prompts the upper support member 200 to rock forward to achieve the back and forth rocking of the camping chair.

In some embodiments, the rocking member is provided with one or more mounting positions for the tension spring, with different mounting positions corresponding to different initial lengths of the tension spring.

For example, at least one of the upper seat 101 or the lower seat 102 may be provided with a plurality of lugs (e.g., a plurality of mounting positions) for the tension spring. When the tension springs 113 are of a same type, different lugs correspond to different initial lengths of the tension springs 113, and the different initial lengths may correspond to a plurality of different tensions, so that the upper support member 200 has different initial positions, which may also correspond to different rocking ranges of the camping chair.

Exemplarily, the tension spring 113 is in an elongated state when the initial length of the tension spring 113 is long, and when the tension spring 113 is provided in a front side orientation of the camping chair, the initial position of the camping chair is tilted forward, and at this time a large thrust is required when leaning backward to make the camping chair to rock backward. Conversely, when the camping chair rocks backward and begins to spring back, it may spring back quickly (rock forward quickly) due to a high tension of the tension spring. For example, when the initial length of the tension spring 113 is close to a length of a natural elongation of the tension spring 113, the restoring force decreases, and the camping chair rocks slowly.

In some embodiments of the present disclosure, by setting different mounting positions for the tension springs, the initial lengths of the tension springs are different, which in turn makes the tension of the tension springs different, and makes the camping chairs have different rocking ranges and be applicable to use needs of different people.

In some embodiments of the present disclosure, by adding the tension spring in the front side orientation of the camping chair, the initial position of the camping chair is tilted forward. When using the camping chair, the user only needs to try his or her best to lean backward, which can be realized by his or her own gravity to rock backward and does not increase the difficulty of pushing. And during the rebound, due to the relatively strong restoring force provided by the contraction tendency of the tension spring, it can quickly and conveniently rock forward, enhancing the user experience.

Figure 10:
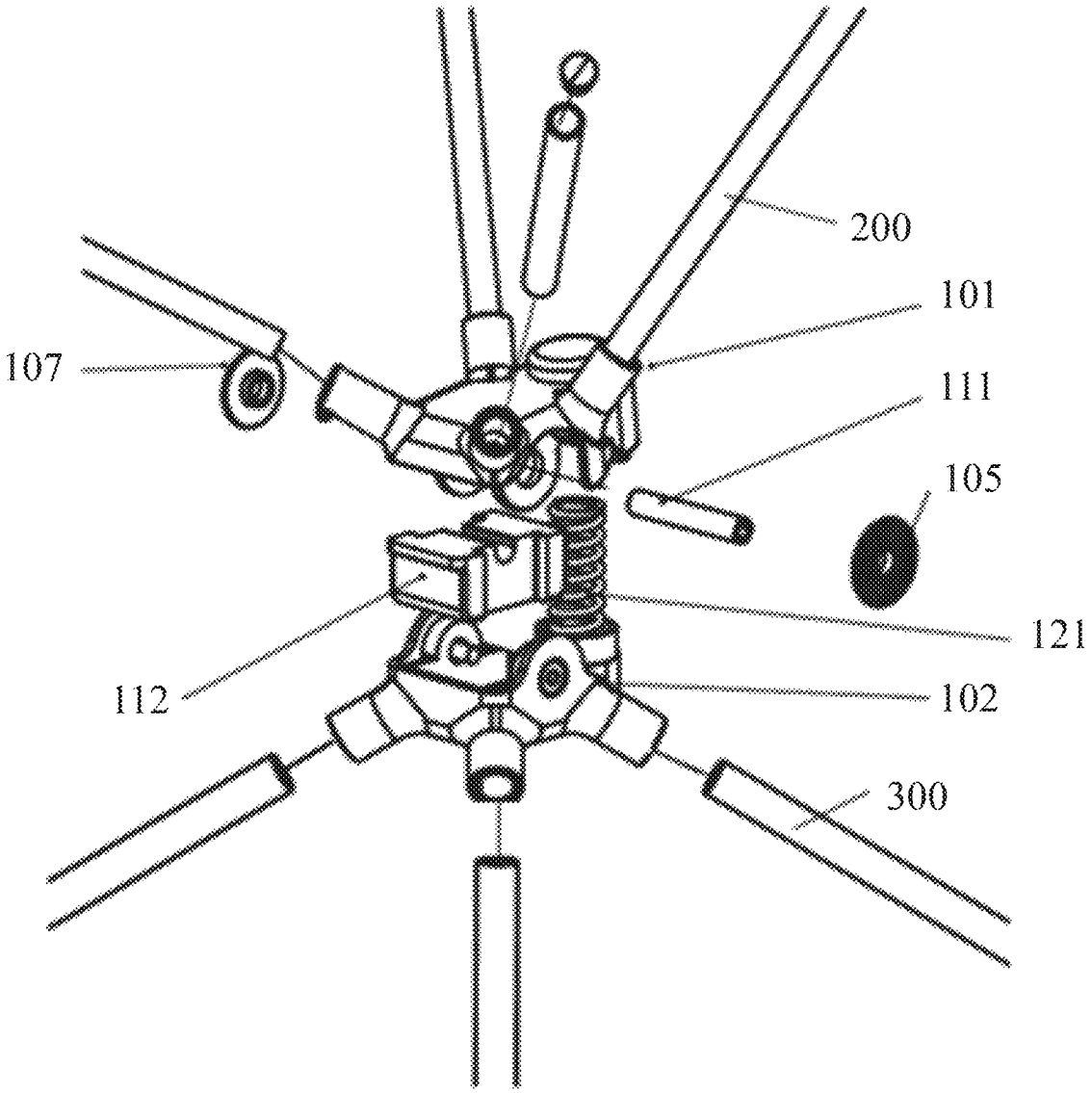
FIG. 10 is a diagram illustrating an exemplary exploded structure of a rocking member including a compression spring according to some embodiments of the present disclosure.

FIG. 10 is a diagram illustrating an exemplary exploded structure of a rocking member including a compression spring according to some embodiments of the present disclosure.

In some embodiments, as shown in FIG. 10, the rocking member 100 includes the upper seat 101, the lower seat 102, the rotation axis 111, the resilient pad 112, and a compression spring 121. The upper seat 101 and the lower seat 102 rotate about the rotation axis 111. The resilient pad 112 is provided between the upper seat 101 and the lower seat 102, an upper end of the compression spring 121 is fixedly connected to the upper seat 101, and a lower end of the compression spring 121 is fixedly connected to the lower seat 102.

More details regarding the upper seat 101, the lower seat 102, the rotation axis 111, and the resilient pad 112 may be found in other contents of the present disclosure (e.g., descriptions in connection with FIG. 7 to FIG. 9).

The compression spring 121 refers to a helical spring that is subjected to axial pressure, also known as a compression spring. When not subjected to a load, there is a gap between the coils of the compression spring. The operation principle of the compression spring is that when subjected to an external load, the compression spring shrinks and deforms, thereby storing deformation energy and providing a reverse elasticity. In some embodiments, the upper end of the compression spring 121 is fixedly connected to the upper seat 101 and the lower end of the compression spring 121 is fixedly connected to the lower seat 102. The fixed connection is similar to that of a tension spring, and is not described herein.

In some embodiments, the compression spring 121 is provided on one side of the resilient pad 112, such as a rear side, as shown in FIG. 10. The compression spring 121 is compressed during installation, causing the upper support member 200 to tilt slightly toward the front side. When the user leans backward on the camping chair, the upper support member 200 rocks backward, at which time the compression spring 121 is in a state of further compression, and the elasticity of the compression spring 121 (the compression spring is compressed with a tendency to elongate back to its original length) prompts the upper support member 200 to have a tendency to rock forward so as to realize the back and forth rocking of the camping chair.

In some embodiments, the compression spring 121 may also be disposed on both sides of the resilient pad 112, such as a front side and a rear side. In some embodiments, the compression springs 121 on the front side and the rear side are compressed differently when installed to allow the upper support member 200 to tilt slightly toward the front side when the camping chair is not in use. When the user leans backward on the camping chair, the upper support member 200 rocks backward, at which time the compression spring 121 on the front side gradually recovers its original length to further provide a force for rocking backward, while the compression spring 121 in the rear side is in a state of further compression, and the elasticity of the compression spring 121 in the rear side (the compression spring is compressed with a tendency to elongate back to its original length) prompts the upper support member 200 to have a tendency to rock forward, so as to realize the back and forth swinging of the camping chair. In this regard, the compression spring on the front side and the compression spring on the rear side may be the same type of compression springs with different lengths, and the compression spring compressed on the front side is shorter than the compression spring compressed in the rear side during installation to allow the upper support member 200 to be tilted slightly toward the front side.

In some embodiments of the present disclosure, by adding the compression spring in a rear side orientation of the camping chair, the initial position of the camping chair is tilted forward. When using the camping chair, the user only needs to try his or her best to lean backward, which can be realized by his or her own gravity to rock backward and does not increase the difficulty of pushing. And during the rebound, due to the relatively strong restoring force provided by the tendency to elongate of the compression spring, it can quickly and conveniently rock forward, enhancing the user experience.

Figure 11:
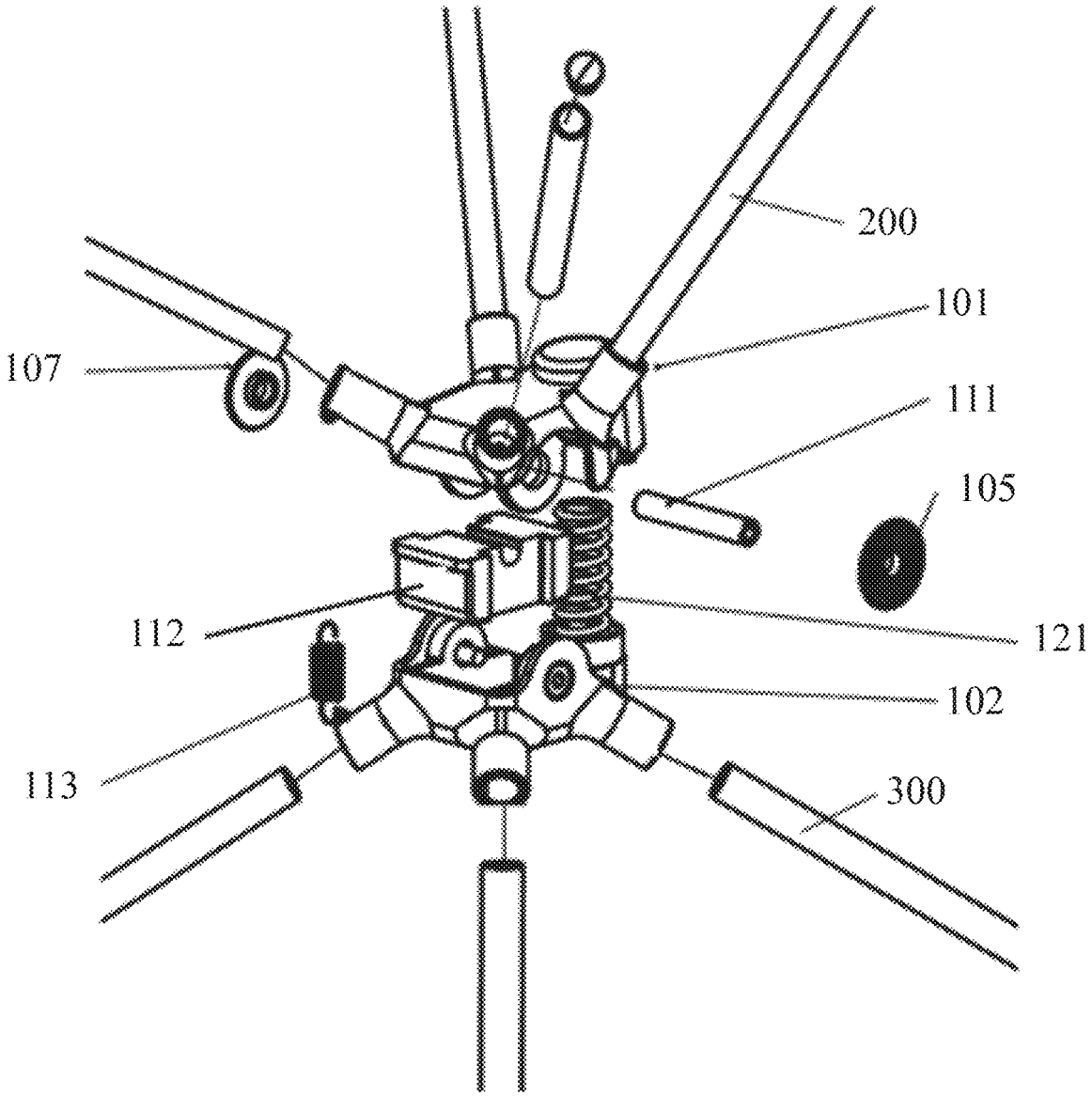
FIG. 11 is a diagram illustrating an exemplary exploded structure of a rocking member including a tension spring and a compression spring according to some embodiments of the present disclosure.

FIG. 11 is a diagram illustrating an exemplary exploded structure of a rocking member including a tension spring and a compression spring according to some embodiments of the present disclosure.

In some embodiments, the rocking member 100 includes the upper seat 101, the lower seat 102, the rotation axis 111, the resilient pad 112, the tension spring 113, and the compression spring 121, as shown in FIG. 11. The upper seat 101 and the lower seat 102 rotate about the rotation axis, the resilient pad 112 is provided between the upper seat 101 and the lower seat 102, the tension spring 113 is provided on a front side of the camping chair close to the seat, the compression spring 121 is provided on a back side of the camping chair away from the seat, the upper end of the tension spring 113 and the upper end of the compression spring 121 are fixedly connected to the upper seat 101, and the lower end of the tension spring 113 and the lower end of the compression spring 121 are fixedly connected to the lower seat 102.

More details regarding the upper seat 101, the lower seat 102, the rotation axis 111, the resilient pad 112, the tension spring 113, and the compression spring 121 may be found in other contents of the present disclosure (e.g., descriptions in connection with FIG. 7 to FIG. 10).

In some embodiments, the tension spring 113 is provided on a front side of the resilient pad 112 and the compression spring 121 is provided on a back side of the resilient pad 112, as illustrated in FIG. 11. The tension spring 113 is stretched during installation, and the compression spring 121 is compressed during installation, allowing the upper support member 200 to remain in a neutral state. When the user leans backward on the camping chair, the upper support member 200 rocks backward, at which time the tension spring 113 is in a state of being further stretched, and the compression spring 121 is in a state of being further compressed. A tension of the tension spring 113 and a elasticity of the compression spring 121 induce the upper support member 200 to rock forward, thereby realizing the back and forth rocking of the camping chair.

In some embodiments of the present disclosure, power is provided to the camping chair by a combination of the tension spring and the compression spring, which can make the force required by the user to use the camping chair become small, and improve the user experience.

In some embodiments, there are a plurality of ways to use the torsion spring, the compression spring, and the tension spring. The torsion spring, the compression spring, and the tension spring may be used individually or in combination. For example, in addition to the above-described ways of use involved, the ways of using may further include setting up both the torsion spring and the tension spring, setting up both the torsion spring and the compression spring, or the like.

In some embodiments, the torsion spring, the compression spring, and the tension spring may be provided in any other feasible position. For example, the compression spring or the tension spring may be provided in the middle of the rocking member 100. As another example, the compression springs or the tension springs may be provided on both sides of the rocking member 100.

FIG. 12 is a diagram illustrating an exemplary structure of an adjusting member according to some embodiments of the present disclosure.

In some embodiments, as shown in FIG. 12, the rocking member 100 further includes a first adjusting member 131, and the first adjusting member 131 adjusts a difficulty degree of rocking of the camping chair by adjusting an elasticity of the torsion spring 103. The first adjusting member 131 is fixedly connected to the torsion spring 103, and the first adjusting member 131 is in threaded connection with either the upper seat 101 or the lower seat 102.

The first adjusting member 131 refers to a component that adjusts the elasticity of the torsion spring. For example, a manual rotary knob, or the like.

In some embodiments, the first adjusting member 131 may be fixedly connection to the torsion spring 103. There may be a plurality of ways to effectuate a fixed connection of the first adjusting member 131 to the torsion spring 103. For example, a torsion spring mounting hole is provided on the circumference of the first adjusting member 131, and the torsion spring 103 is secured in the mounting hole. As another example, the first adjusting member 131 is provided with a lug protrusion close to an end face of the torsion spring, and the torsion spring 103 is fixed in the lug.

In some embodiments, the difficulty degree of rocking may characterize an amount of force required to rock the camping chair. The difficulty degree of rocking may be characterized by a numerical value, where a larger numerical value indicates that it is more difficult to wobble the camping chair, and a smaller numerical value indicates that it is easier to wobble the camping chair.

In some embodiments, the greater the compression of the torsion spring (i.e., the tighter the torsion spring is compressed), the greater the force required to rock the camping chair, corresponding to a higher difficulty degree of rocking, and the more difficult it is to rock the camping chair. The less compression of the torsion spring, the less force required to rock the camping chair, corresponding to a lower difficulty degree of rocking, and the easier it is to rock the camping chair.

In some embodiments, the first adjusting member may be in the threaded connection with either the upper seat 101 or the lower seat 102. For example, the first adjusting member may be a rotary knob, and by rotating the first adjusting member, the first adjusting member moves relative to the upper seat 101 or the lower seat 102, which in turn drives a lateral deformation (stretching or compression) of the torsion spring.

As shown in FIG. 12, when a rotation direction of the first adjusting member 131 is in the same direction as a direction of the torsion spring twisting, when the first adjusting member 131 is rotated, the first adjusting member is moved inwardly relative to the upper seat 101 or the lower seat 102, and the torsion spring is compressed. The greater the rotation of the first adjusting member, the greater the compression of the torsion spring, the greater the force required to rock the camping chair, and the more difficult it is to rock the camping chair.

In some embodiments, thread directions of the first adjusting members 131 on the left side and the right side may be opposite (i.e., one is a left-handed thread and the other is a right-handed thread), or the thread directions of the first adjusting members 131 on the left side and the right side are the same, but is opposite to the rotation direction of the torsion spring when it is mounted. At this time, rotating the first adjusting member on the two sides respectively may make the pulling force of the torsion spring on the left hand and the torsion spring on the right hand opposite, which makes an initial position (position when not subjected to external force) of the camping chair is a centered position.

In some embodiments of the present disclosure, by setting the first adjusting member, the elasticity of the torsion spring can be flexibly adjusted, which in turn makes the difficulty degree of rocking of the camping chair in line with use habits of the user, and enhance the user experience.

In some embodiments, the first adjusting member 131 may be provided with a scale line, the scale line being configured to align with a zero position, and the zero position is a position corresponding to the torsion spring in a natural state.

In some embodiments of the present disclosure, a provision of the scale line enables the user to adjust the torsion spring to a suitable position according to actual needs through the first adjusting member, and to adjust the force required for the rocking of the camping chair.

In some embodiments, the rocking member further includes a second adjusting member, and the second adjusting member adjusts the difficulty degree of rocking of the camping chair by adjusting the elasticity of the torsion spring.

The second adjusting member refers to a component that adjusts the elasticity of the torsion spring. For example, a motorized rotary knob, or the like.

In some embodiments, the second adjusting member includes a microprocessor, a drive device, an input device, and a communication device; and the microprocessor is configured to determine an adjustment instruction. The drive device is configured to adjust the elasticity of the torsion spring based on the adjustment instruction; and the drive device is connected to the first adjusting member or the torsion spring. The input device is configured to input a wobble sensitivity of a current user, and the wobble sensitivity is used to measure the difficulty degree of rocking of the camping chair. The communication device is configured to communicate with the drive device, the input device and the microprocessor.

The microprocessor refers to a central processor consisting of an integrated circuit. For example, an embedded microprocessor, or the like. In some embodiments, the microprocessor may determine and execute the adjustment instruction and process various data in the second adjusting member.

The drive device refers to a component that is configured to control the tightening and loosening of the torsion spring. For example, a motor, or the like. In some embodiments, the drive device may be disposed close the torsion spring of the camping chair for tightening or loosening the torsion spring based on the adjustment instruction for the purpose of adjusting the torsion spring. In some embodiments, the manner in which the drive device controls the tightening or loosening of the torsion spring may be multiple. For example, the drive device is connected to the first adjusting member to drive the torsion spring to be tightened or loosened by controlling a rotation angle of the first adjusting member. As another example, without the need for the first adjusting member, the drive device is directly connected to the torsion spring to drive the torsion spring to be tightened or loosened. In some embodiments, the drive device may return the torsion spring to an initial state prior to each adjustment; and the initial state may be either the torsion spring is fully torqued loose or fully torqued tight. Fully torqued loose refers to a state that the torsion spring is in a natural elongation state, and fully torqued tight refers to a state that the torsion spring is in a state in which it is fully compressed and no longer be twisted.

The input device refers to a device that is configured to pass user input to the microprocessor or other electronic device. In some embodiments, the input device may be set in any feasible position, for example, on the camping chair (e.g., on one side of the rocking member, on an upper tube), on an external device (e.g., a remote control device), embedded in a client, or the like.

In some embodiments, forms of the input device may include a touchable display, a normal key panel, a knob for gear adjustment, or the like. In some embodiments, a choice of the forms of the input device may be set as desired. For example, when the current user has fewer wobble sensitivity gears, a common low-grammed key panel may be selected.

In some embodiments, the input device is configured to input the wobble sensitivity of the current user.

The wobble sensitivity refers to a sensitivity degree of a user to the difficulty degree of rocking of the camping chair, and may characterize a preference choice of the user of the difficulty degree of rocking of the camping chair. In some embodiments, the wobble sensitivity may be represented in a plurality of ways. For example, the wobble sensitivity may be represented by a plurality of preset grades such as flexible, more flexible, and stable. The flexible grade refers that it is easier to rock the camping chair and the stable grade refers that it is more difficult to rock the camping chair. As another example, the wobble sensitivity may also be represented by a discrete value from 0 to 100, and the higher the discrete value, the higher the wobble sensitivity, corresponding to the more difficult rocking of the camping chair.

In some embodiments, the microprocessor is set up in a similar position as the input device. For example, the microprocessor may be the processor of a cell phone of the user when the input device is the diaplay of the cell phone of the user.

The communication device refers to a component that is configured to communicate and connect with other devices, and to transfer data and instructions. For example, the communication device may be a network card, a modem, a fiber optic transceiver, or the like. In some embodiments, the communication device may be provided in the drive device, the input device, and the microprocessor.

In some embodiments, the input device and the microprocessor are preferred to be located in an external device or embedded in the client to make the chair lighter overall.

In some embodiments, the user inputs the wobble sensitivity via the input device, and the microprocessor may obtain the wobble sensitivity via the communication device and determine an adjustment instruction based on the wobble sensitivity.

The adjustment instruction refers to an instruction for adjusting the difficulty degree of rocking of the camping chair. In some embodiments, the adjustment instructions may include rotation directions and number of rotations of each torsion spring.

In some embodiments, the microprocessor may determine the adjustment instruction in a plurality of ways. For example, the microprocessor may obtain, from the communication device, the wobble sensitivity entered by the user via the input device, and determine the adjustment instruction, via a preset table based on the wobble sensitivity.

The preset table may include a correspondence relationship between the wobble sensitivity and the adjustment instruction. In some embodiments, the preset table may be obtained in a plurality of ways. For example, the preset table may be constructed based on experimental data. Exemplarily, the user tightens or loosens the torsion spring, tests and records the wobble sensitivities at different numbers of rotations, averages a plurality of wobble sensitivities corresponding to a same rotation direction and a same number of rotations for a plurality of tests, and records the average value of the wobble sensitivities into the preset table to determine the rotation direction and the number of rotations and the corresponding wobble sensitivity (to determine the adjustment instruction and the corresponding wobble sensitivity).

In some embodiments of the present disclosure, motorized adjustment of the camping chair can be realized by setting the second adjusting member, which makes it convenient for the user to use the camping chair. The input device can reduce a difficulty of adjusting the difficulty degree of rocking of the camping chair and improve the user experience. For example, the user can adjust the chair by directly selecting the corresponding buttons, without having to think about which direction to rotate in, and how far to rotate to achieve a flexibility degree.

In some embodiments, the second adjusting member further includes a monitoring recorder and a cloud-based database. The monitoring recorder is configured to monitor and record wobble data of the current user and the wobble sensitivity. The cloud-based database is configured to periodically collect and store the wobble data and the wobble sensitivity obtained by the monitoring recorder. The input device is further configured to input an adaptive mode, and the adaptive mode is configured to periodically determine the wobble sensitivity based on the cloud-based database.

The monitoring recorder refers to a component that monitors and records the wobble data the current user and the wobble sensitivity.

The wobble data of the current user refers to data related to wobble situation of the camping chair that is used by a user. In some embodiments, the wobble data of the current user may be obtained in a plurality of ways. For example, the wobble data of the current user may be obtained through the monitoring recorders such as an inclination sensor, a displacement sensor, or the like.

In some embodiments, the monitoring recorder may obtain the adjustment instruction via the communication device, and determine the wobble sensitivity of the current user based on the adjustment instruction. In this regard, determining the wobble sensitivity of the current user based on the adjustment instruction may be accomplished by querying the preset table.

The cloud-based database refers to a component that periodically collects and stores the wobble data and the wobble sensitivity from the monitoring recorder. In some embodiments, the wobble data and the wobble sensitivities of a large number of users are stored in the cloud-based database, including, but not exclusively only, the wobble data of the current user and the wobble sensitivities.

The adaptive mode refers to a mode in which the wobble sensitivity may be adaptively adjusted based on behaviors of the user without user inputs. In some embodiments, the adaptive mode may be set by the user via the input device for periodically and autonomously determining the wobble sensitivity based on the cloud-based database.

In some embodiments, periodically determining the wobble sensitivity based on the cloud-based database includes: periodically obtaining the wobble data of the current user and the wobble sensitivity for a previous cycle from the monitoring recorder; obtaining a vector database from the cloud-based database; and determining, by the vector database, the wobble sensitivity for a current cycle of the current user, based on the wobble data and the wobble sensitivity of the current user for the previous cycle. The cycle may be set by the microprocessor by default or by the user autonomously. For example, 1 day, 1 week, or the like.

In some embodiments, ways of obtaining the vector database based on the cloud-based database may include multiple. For example, based on the cloud-based database, the wobble data and the wobble sensitivities for a plurality of historical first cycles and a plurality of historical second cycles are obtained, with the historical second cycle being after the historical first cycle and the historical second cycle being the next cycle of the historical first cycle. A to-be-clustered vector is constructed by using the wobble data and the wobble sensitivities of the historical first cycle and the wobble sensitivities of the historical second cycle corresponding to the historical first cycle, and then a plurality of to-be-clustered vectors are constructed based on the cloud-based database. The plurality of to-be-clustered vectors are clustered to form a plurality of clustering centers, and a clustering center includes the wobble data of the historical first cycle, the wobble sensitivity of the historical first cycle, and the wobble sensitivity of the historical second cycle corresponding to the historical first cycle. The wobble data and the wobble sensitivity of the historical first cycle corresponding to one of the clustering centers are determined as a criterion vector, the wobble sensitivity of the historical second cycle corresponding to the clustering center is determined as a label of the criterion vector, and then a plurality of criterion vectors and the corresponding plurality of labels are determined based on the plurality of clustering centers, and the vector database is constructed based on the plurality of criteria vectors and the corresponding plurality of labels.

In some embodiments, there are a plurality of ways of determining the wobble sensitivity for the current cycle of the current user via the vector database, based on the wobble data and the wobble sensitivity for the previous cycle of the current user. For example, a to-be-matched vector is constructed based on the wobble data and the wobble sensitivity of the current user for the previous cycle, and a plurality of vector similarities between the to-be-matched vector and the plurality of criterion vectors in the vector database are calculated. The label corresponding to the criterion vector with the highest vector similarity is used as the wobble sensitivity for the current cycle of the current user. The vector similarity may be expressed by cosine similarity, Euclidean distance, or the like.

As another example, an average of the plurality of wobble sensitivities for the previous cycle of the current user is used as the wobble sensitivity for the current cycle of the current user.

In some embodiments of the present disclosure, the wobble sensitivity can be automatically adjusted according to the behaviors of the user by setting the adaptive mode, which does not require any additional operation by the user, and improves the user experience.

In some embodiments, the second adjusting member further includes a reminder component, the reminder component being configured to display a reminder message to the current user. The input device is also configured to receive user update feedback and user update requests. The monitoring recorder is also configured to record a count of user adjustments. The microprocessor is further configured to: in response to determining that an update triggering condition is satisfied, generate the reminder message and send the reminder message to the reminder component, the update triggering condition including that the input device receives the user update request, and/or the count of user adjustments the user in a predetermined time period is greater than a predetermined threshold.

The reminder component refers to a component that displays the reminder message to the user. The reminder message refers to a message related to reminding the user to make an update. In some embodiments, the reminder component may be provided in any feasible position, for example, located on an external device, embedded in a client, or the like. Exemplarily, the reminder component may be the same device as the input device (e.g., the display of the cell phone of the user), and the reminder component may also be a speaker within the cell phone of the user or a separately set speaker, or the like.

In some embodiments, different reminder components display the reminder message to the current user in different ways. For example, the display may be reminded by text, the speaker may be reminded by voice, or the like.

The user update feedback refers to information about a feedback by a user to update the vector database. In some embodiments, the user update feedback may include update or no update. Exemplarily, the user update feedback may be represented by a boolean value, for example, 1 for update and 0 for no update.

The user update request refers to information about a request by a user to update the vector database. In some embodiments, the user update request may include an update request or no update request. Exemplarily, the user update request may be represented by a boolean value, with 1 representing an update request and 0 representing no update request.

The count of user adjustments refers to a count of times a user has made adjustments to the first adjusting member or the second adjusting member. For example, the count of user adjustments may be a count of automatic or manual adjustments of the second adjusting member or a count of manual adjustments of the first adjusting member.

The update triggering condition refers to a trigger condition that updates the vector database. In some embodiments, the update triggering condition includes that the input device receives the user update request, and/or the count of user adjustments in the predetermined time period is greater than the predetermined threshold. The predetermined time period refers to a predetermined period of time, for example, 0.5 h, 1 h, or the like. The predetermined threshold refers to a maximum value of the count of user adjustments in the predetermined time period when there is no need to update the vector database. In some embodiments, the predetermined time period and the predetermined threshold may be set by default by the microprocessor or preset by a technician based on user needs or historical experience.

In some embodiments, in response to determining that the update triggering condition is satisfied, the microprocessor may generate the reminder message and send the reminder message to the reminder component. For example, in response to determining that the user update request of 1 is obtained from the input device, the microprocessor may generate a voice reminder "Please update the vector database!" and send it to the speaker.

In some embodiments, after the update triggering condition is satisfied, in response to determining that the user update feedback is received as an update (e.g., 1), the microprocessor may update the vector database, to prevent the user update request from being a user mis-trigger. In this regard, updating the vector database includes: based on the latest uploaded data in the cloud-based database and historical data within a historical time period, reclustering to form new criterion vectors and labels to form a new vector database. The historical time period refers to a time period before the current moment. In some embodiments, a duration of the historical time period may be set by the microprocessor by default or preset manually based on user needs or empirical values.

In some embodiments of the present disclosure, after satisfying the update triggering condition, the database is updated based on confirming the update feedback, and by confirming it twice, the false touch can be effectively prevented; at the same time, the user can take the initiative to update the database to more quickly match a close adaptive mode to meet adjustment needs of the user.

The basic concepts have been described above, and it is apparent to those skilled in the art that the foregoing detailed disclosure is intended as an example only and does not constitute a limitation of the present disclosure. While not expressly stated herein, a person skilled in the art may make various modifications, improvements, and amendments to the present disclosure. Those types of modifications, improvements, and amendments are suggested in the present disclosure, so those types of modifications, improvements, and amendments remain within the spirit and scope of the exemplary embodiments of the present disclosure.

Also, the present disclosure uses specific words to describe embodiments of the present disclosure. For example, "one embodiment", "an embodiment", and/or "some embodiment" means a feature, structure, or characteristic associated with at least one embodiment of the present disclosure. Accordingly, it should be emphasized and noted that "an embodiment" or "one embodiment" or "an alternative embodiment" referred to two or more times in different locations in the present disclosure do not necessarily refer to the same embodiment. In addition, certain features, structures, or characteristics in one or more embodiments of the present disclosure may be suitably combined.

Additionally, unless expressly stated in the claims, the order of the processing elements and sequences, the use of numerical letters, or the use of other names as described in the present disclosure are not intended to qualify the order of the processes and methods of the present disclosure. Although some embodiments of the invention that are currently considered useful have been discussed through various examples in the foregoing disclosure, it should be understood that such details are intended for illustrative purposes only. The appended claims are not limited to the disclosed embodiments; rather, they are intended to cover all modifications and equivalent combinations that fall within the spirit and scope of the embodiments described herein. For example, although the implementation of various components described above may be embodied in a hardware device, it may also be implemented as a software only solution, e.g., an installation on an existing server or mobile device.

Similarly, it should be noted that in order to simplify the disclosure of the present disclosure and aid in the understanding of one or more embodiments of the invention, various features may sometimes be grouped together into a single embodiment, figure, or description thereof in the description of the embodiments herein. However, this method of disclosure does not imply that more features are required for the objects of the present disclosure than are mentioned in the claims. Rather, claimed subject matter may lie in less than all features of a single foregoing disclosed embodiment.

In some embodiments, numbers are used to describe quantities of components or attributes. It should be understood that such numbers used in the description of embodiments are sometimes modified by terms like 'about,' 'approximately,' or 'substantially. Unless otherwise noted, the terms "about," "approximately," or "substantially" indicates that a ±20% variation in the stated number is allowed. Correspondingly, in some embodiments, the numerical parameters used in the present disclosure and claims are approximations, which may change depending on the desired characteristics of individual embodiments. In some embodiments, the numerical parameters should take into account the specified number of valid digits and employ general place-keeping. While the numerical domains and parameters used to confirm the breadth of the ranges in some embodiments of the present disclosure are approximations, in specific embodiments such values are set to be as precise as possible within a feasible range.

For each patent, patent application, patent application disclosure, and other material cited in the present disclosure, such as articles, books, manuals, publications, documents, etc., the entire contents of which are hereby incorporated herein by reference. Application history documents that are inconsistent with or conflict with the contents of the present disclosure are excluded, as are documents (currently or hereafter appended to the present disclosure) that limit the broadest scope of the claims of the present disclosure. It should be noted that in the event of any inconsistency or conflict between the descriptions, definitions, and/or use of terms in the materials appended to the present disclosure and those set forth herein, the descriptions, definitions and/or use of terms in the present disclosure shall prevail.

Finally, it should be understood that the embodiments described in the present disclosure are only used to illustrate the principles of the embodiments of the present disclosure. Other deformations may also fall within the scope of the present disclosure. As such, alternative configurations of embodiments of the present disclosure may be viewed as consistent with the teachings of the present disclosure as an example, not as a limitation. Correspondingly, the embodiments of the present disclosure are not limited to the embodiments expressly presented and described herein.

What is claimed is:

1. A camping chair, comprising a rocking member, an upper support member, a lower support member and a seat, wherein:

two ends of the rocking member are connected to the upper support member and the lower support member respectively, and the rocking member includes an elastic device providing rotational resistance and/or restoring force;

the upper support member includes several first pipe fittings, one end of each first pipe fitting is connected to the rocking member, and the other end of the each first pipe fitting is connected to the seat;

the lower support member includes several second pipe fittings, one end of each second pipe fitting is connected to the rocking member, and the other end of the each second pipe fitting is in contact with the ground; and the rocking member includes an upper seat, a lower seat, a rotation axis, a resilient pad, and a tension spring, wherein the upper seat and the lower seat rotate about the rotation axis, the resilient pad is provided between the upper seat and the lower seat, an upper end of the tension spring is fixedly connected to the upper seat, and a lower end of the tension spring is fixedly connected to the lower seat.

2. The camping chair of claim 1, wherein the two ends of the rocking member are detachably connected to the upper support member and the lower support member respectively, wherein the each first pipe fitting of the upper support member includes an upper tube and a first elastic cord, one end of the first elastic cord is connected to the upper tube, and the other end of the first elastic cord is connected to the rocking member;

the each second pipe fitting of the lower support member includes a foot tube and a second elastic cord, one end of the second elastic cord is connected to the foot tube, and the other end of the second elastic cord is connected to the rocking member.

3. The camping chair of claim 2, wherein the each first pipe fitting further includes an extension tube and a pipe plug, the extension tube is fixedly connected to the upper tube; one end of the first elastic cord is connected to the pipe plug, and the other end of the first elastic cord is connected to the rocking member;

the each second pipe fitting further includes a foot pad, and the foot pad is connected to the foot tube.

4. The camping chair of claim 3, wherein one or more of the upper tube, the foot tube and the extension tube is a plastic pipe fitting with reinforcing ribs or is a plastic inner pipe internally sheathed with reinforcing ribs, the plastic inner pipe with reinforcing ribs is disposed between the upper tube and the first elastic cord, between the foot tube and the second elastic cord, or between the extension tube and the first elastic cord.

5. The camping chair of claim 1, wherein the rocking member includes a torsion spring, wherein two ends of the torsion spring are fixedly connected to the upper seat and the lower seat respectively;

the upper seat includes an upper connector, and the upper connector is connected to the upper support member;

the lower seat includes a lower connector, and the lower connector is connected to the lower support member.

6. The camping chair of claim 5, wherein a count of the torsion springs is one or more, each torsion spring has the same or different diameters at both ends, and the each torsion spring is provided with a sound insulating sleeve on an outer side.

7. The camping chair of claim 5, wherein the rocking member further includes a first adjusting member, the first adjusting member adjusts a difficulty degree of rocking of the camping chair by adjusting an elasticity of the torsion spring, wherein the first adjusting member is fixedly connected to the torsion spring and the first adjusting member is in threaded connection with either the upper seat or the lower seat.

8. The camping chair of claim 1, wherein the rocking member is provided with one or more mounting positions for the tension springs, different mounting positions corresponding to different initial lengths of the tension springs.

9. The camping chair of claim 1, wherein the rocking member includes a compression spring, wherein an upper end of the compression spring is fixedly connected to the upper seat, and a lower end of the compression spring is fixedly connected to the lower seat.

10. The camping chair of claim 1, wherein the rocking member includes a compression spring, wherein the tension spring is provided on a front side of the camping chair close to the seat, the compression spring is provided on a back side of the camping chair away from the seat, an upper end of the tension spring and an upper end of the compression spring are fixedly connected to the upper seat, and a lower end of the tension spring and a lower end of the compression spring are fixedly connected to the lower seat.

11. The camping chair of claim 1, wherein the camping chair further includes one or more reinforcing members, each reinforcing member is configured to connect adjacent first pipe fittings and/or adjacent second pipe fittings, wherein a reinforcing member of the one or more reinforcing members includes two rods that are hingedly connected and two sleeves, the two sleeves are sleeved on adjacent first pipe fittings and/or the two sleeves are sleeved on adjacent second pipe fittings.

12. The camping chair of claim 11, wherein the camping chair further includes a reinforcement assembly composed of multiple reinforcing members.

13. The camping chair of claim 11, wherein the reinforcing member further includes a hinged limiter, the hinged limiter is configured to determine a maximum extended hinge position.

14. A camping chair, comprising a rocking member, an upper support member, a lower support member and a seat, wherein:

two ends of the rocking member are connected to the upper support member and the lower support member respectively, and the rocking member includes an elastic device providing rotational resistance and/or restoring force;

the upper support member includes several first pipe fittings, one end of each first pipe fitting is connected to the rocking member, and the other end of the each first pipe fitting is connected to the seat;

the lower support member includes several second pipe fittings, one end of each second pipe fitting is connected to the rocking member, and the other end of the each second pipe fitting is in contact with the ground; and the rocking member includes an upper seat, a lower seat, a rotation axis, a resilient pad, and a compression spring, wherein the upper seat and the lower seat rotate about the rotation axis, the resilient pad is provided between the upper seat and the lower seat, an upper end of the compression spring is fixedly connected to the upper seat, and a lower end of the compression spring is fixedly connected to the lower seat.

15. A camping chair, comprising a rocking member, an upper support member, a lower support member and a seat, wherein:

two ends of the rocking member are connected to the upper support member and the lower support member respectively, and the rocking member includes an elastic device providing rotational resistance and/or restoring force;

the upper support member includes several first pipe fittings, one end of each first pipe fitting is connected to the rocking member, and the other end of the each first pipe fitting is connected to the seat;

the lower support member includes several second pipe fittings, one end of each second pipe fitting is connected to the rocking member, and the other end of the each second pipe fitting is in contact with the ground; and the rocking member includes an upper seat, a lower seat, a rotation axis, a resilient pad, a tension spring, and a compression spring, wherein the upper seat and the lower seat rotate about the rotation axis, the resilient pad is provided between the upper seat and the lower seat, the tension spring is provided on a front side of the camping chair close to the seat, the compression spring is provided on a back side of the camping chair away from the seat, an upper end of the tension spring and an upper end of the compression spring are fixedly connected to the upper seat, and a lower end of the tension spring and a lower end of the compression spring are fixedly connected to the lower seat.

* * * * *